US008012267B2

(12) United States Patent
Jekel et al.

(10) Patent No.: US 8,012,267 B2
(45) **Date of Patent: *Sep. 6, 2011**

(54) MACHINE DISHWASHING METHOD WITH SEPARATELY METERED LIQUID CLEANING AGENTS

(75) Inventors: Maren Jekel, Willich (DE); Johannes Zipfel, Duesseldorf (DE); Arnd Kessler, Monheim am Rhein (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 154 days.

This patent is subject to a terminal disclaimer.

(21) Appl. No.: 12/339,220

(22) Filed: Dec. 19, 2008

(65) Prior Publication Data

US 2009/0183755 A1 Jul. 23, 2009

Related U.S. Application Data

(63) Continuation of application No. PCT/EP2007/056046, filed on Jun. 19, 2007.

(30) Foreign Application Priority Data

Jun. 20, 2006 (DE) ..... 10 2006 028 750

(51) Int. Cl.
*B08B 3/08* (2006.01)
*C11D 7/42* (2006.01)

(52) U.S. Cl. ..... 134/25.2; 134/25.3; 134/26; 510/226; 510/300; 510/320; 510/392; 510/406; 510/439

(58) Field of Classification Search ..... 134/25.2, 134/25.3; 510/197, 226, 300, 320, 392, 406
See application file for complete search history.

(56) References Cited

U.S. PATENT DOCUMENTS

| | | | | |
|---|---|---|---|---|
| 4,162,987 | A * | 7/1979 | Maguire et al. | 510/226 |
| 4,243,543 | A | 1/1981 | Guilbert et al. | |
| 5,240,633 | A | 8/1993 | Ahmed et al. | |
| 5,310,090 | A | 5/1994 | Taylor, Jr. | |
| 5,372,740 | A | 12/1994 | Fair et al. | |
| 6,670,314 | B2 | 12/2003 | Smith et al. | |
| 6,699,828 | B1 | 3/2004 | De Buzzaccarini et al. | |
| 6,844,305 | B1 | 1/2005 | Depoot et al. | |
| 7,064,099 | B1 * | 6/2006 | Gassenmeier et al. | 510/441 |
| 7,424,891 | B2 * | 9/2008 | Gentschev et al. | 134/25.2 |
| 2002/0142931 | A1 | 10/2002 | DeNome et al. | |
| 2002/0169090 | A1 * | 11/2002 | Foley et al. | 510/218 |
| 2002/0169092 | A1 * | 11/2002 | Alexandre Catlin et al. | 510/220 |
| 2004/0018953 | A1 | 1/2004 | Kinloch et al. | |
| 2004/0115375 | A1 * | 6/2004 | Duffield et al. | 428/34.1 |
| 2004/0147423 | A1 | 7/2004 | Scialla et al. | |
| 2005/0075258 | A1 * | 4/2005 | Kessler et al. | 510/221 |
| 2005/0139608 | A1 | 6/2005 | Muehlhausen et al. | |
| 2005/0227896 | A1 | 10/2005 | Speckmann et al. | |
| 2007/0029344 | A1 | 2/2007 | Schymitzek et al. | |
| 2007/0054828 | A1 | 3/2007 | Gentschev et al. | |
| 2007/0054829 | A1 | 3/2007 | Gentschev et al. | |
| 2009/0165821 | A1 | 7/2009 | Gentschev et al. | |
| 2009/0183755 | A1 | 7/2009 | Jekel et al. | |
| 2009/0239778 | A1 | 9/2009 | Gentschev et al. | |

FOREIGN PATENT DOCUMENTS

| | | | |
|---|---|---|---|
| DE | 10238431 | A1 | 3/2004 |
| DE | 10257387 | A1 | 6/2004 |
| DE | 10313453 | A1 | 10/2004 |
| DE | 102005041708.6 | | 3/2007 |
| EP | 1 275 708 | B1 | 1/2003 |
| EP | 1518922 | A1 | 3/2005 |
| WO | WO 97/18287 | | 5/1997 |
| WO | WO 97/31087 | A1 | 8/1997 |
| WO | WO 01/38477 | A1 | 5/2001 |
| WO | WO 2004/009753 | A1 | 1/2004 |
| WO | WO 2005/035707 | A1 | 4/2005 |
| WO | WO 2005/056744 | A1 | 6/2005 |
| WO | WO 2005/080224 | A1 | 9/2005 |
| WO | WO 2007/025665 | A2 | 3/2007 |
| WO | WO 2007/025666 | A2 | 3/2007 |

OTHER PUBLICATIONS

International Search Report of PCT/EP2007/056046, dated Oct. 4, 2007.
Office Action dated Oct. 2, 2009, in U.S. Appl. No. 12/064,693, filed May 27, 2009.
Office Action dated Jun. 23, 2010, in U.S. Appl. No. 12/064,693, filed May 27, 2009.
Amendment filed on Mar. 31, 2010, in response to the Office Action dated Oct. 2, 2009, in U.S. Appl. No. 12/064,693, filed May 27, 2009.
Amendment filed on Sep. 23, 2010, in response to the Office Action dated Jun. 23, 2010, in U.S. Appl. No. 12/064,693, filed May 27, 2009.
Office Action dated Dec. 8, 2010, in U.S. Appl. No. 12/064,693, filed May 27, 2009.
Amendment filed Feb. 4, 2011, in response to the Office Action dated Oct. 27, 2010, in U.S. Appl. No. 12/064,700, filed Aug. 18, 2008.
Office Action dated Oct. 27, 2010, in U.S. Appl. No. 12/064,700, filed Aug. 18, 2008.

* cited by examiner

*Primary Examiner* — Michael Barr
*Assistant Examiner* — Saeed T Chaudhry
(74) *Attorney, Agent, or Firm* — RatnerPrestia

(57) ABSTRACT

A method of machine cleaning dishes in a dishwasher, wherein over the course of a cleaning program, having a pre-rinsing operation and a cleaning operation, two liquid cleansers A and B having the following composition: A:—10 to 75 wt % of builder(s); −0.1 to 10 wt % of enzyme(s); −24.9 to 89.9 wt % of solvent; and B: −10 to 74.9 wt % of builder(s); −25 to 89.9 wt % of solvent; are metered into the wash bath at two successive times t1 and t2. The liquid cleanser A has a pH value (20° C.) of between 6 and 9 and is metered in at time t1, while the liquid cleanser B has a pH value (20° C.) of between 9 and 14 and is metered in at time t2.

20 Claims, No Drawings

MACHINE DISHWASHING METHOD WITH SEPARATELY METERED LIQUID CLEANING AGENTS

CROSS REFERENCE TO RELATED APPLICATIONS

This application is a continuation under 35 U.S.C. §§120 and 365(c) of International Application PCT/EP2007/056046, filed on Jun. 19, 2007. This application also claims priority under 35 U.S.C. §119 of DE 10 2006 028 750.9 filed on Jun. 20, 2006. The disclosures of PCT/EP2007/056046 and DE 10 2006 028 750.9 are incorporated by reference in their entirety.

BACKGROUND OF THE INVENTION

The present patent application relates to a method for cleaning dishes. In particular, this patent application relates to a method for cleaning dishes in which liquid cleaning agents are metered into the interior of a dishwashing machine with a time lag.

Dishwashing agents are available to the consumer in a variety of forms. In addition to the traditional liquid hand dishwashing agents, machine dishwashing agents have gained major importance with the growing popularity of household dishwashing machines. These machine dishwashing agents are typically offered to the consumer in solid form, e.g., as a powder or tablets.

One of the main goals of the manufacturers of machine cleaning agents is to improve the cleaning performance of these agents; in recent times, a great deal of attention has been directed to cleaning performance in low temperature cleaning cycles and/or in cleaning cycles with reduced water consumption.

To solve these problems, preferably novel ingredients, e.g., more effective surfactants, polymers or bleaching agents have been added to the cleaning agents. However, there are natural limits to this approach to solving the problem, since novel ingredients are available only to a limited extent and, for ecological and economic reasons, the amount of ingredients used per cleaning cycle may not be increased to an unlimited extent.

Another approach to improve the performance profile of existing detergents or cleaning agents consists of developing novel packaged forms, e.g., in the combination of solid and liquid detergent or cleaning agent ingredients.

DESCRIPTION OF THE INVENTION

The object of the present patent application is to provide a cleaning agent for cleaning dishes that is characterized by low water consumption due to an improved cleaning power in comparison with traditional dishwashing agents even in low temperature cleaning cycles and/or in cleaning cycles with low water consumption.

This object has been achieved by a special dishwashing method in which liquid cleaning agent is metered into the interior of a dishwashing machine with a time lag.

A first subject matter of this patent application is therefore a method for machine cleaning of dishes in a dishwashing machine, wherein during the course of a cleaning program comprising a prerinse cycle and a cleaning cycle, two liquid cleaning agents A and B of the following composition:

A:

10 to 75 wt % builder(s), 0.1 to 10 wt % enzyme(s), 24.9 to 89.9 wt % solvent(s), and

B:

10 to 74.9 wt % builder(s), 25 to 89.9 wt % solvent(s), are metered into the interior of the dishwashing machine at two successive times t1 and t2 during this cleaning cycle, such that the liquid cleaning agent A has a pH (20° C.) between 6 and 9 and is metered at time t1, while the liquid cleaning agent B has a pH (20° C.) between 9 and 14 and is metered at time t2.

The inventive process is performed in the interior of a conventional dishwashing machine. As a rule, the cleaning program may be selected and determined by the consumer by performing the dishwashing method in a dishwashing machine.

The cleaning program of the dishwashing machine used in the invention method comprises at least one prerinse cycle and a cleaning cycle. According to the invention, cleaning programs comprising additional cleaning cycles or rinse cycles, e.g., a clear rinse cycle, are preferred. The inventive process is therefore not limited to such cleaning programs consisting exclusively of a prerinse cycle and a cleaning cycle.

The inventive process is especially preferably part of a cleaning program comprising a prerinse cycle, a cleaning cycle and a clear rinse cycle. The cleaning programs of automatic dishwashing machines may differ with regard to their duration, their water consumption and the temperature of the cleaning bath. The inventive process is preferably used in conjunction with such cleaning programs in which the wash bath is heated in the course of the cleaning cycle.

In a preferred embodiment of the inventive process, the cleaning cycle during the course of which the cleaning agents A and B are metered into the interior of the dishwashing machine is characterized in that during the course thereof, the temperature of the cleaning bath rises to levels above 30° C., preferably above 40° C. and in particular above 50° C.

In a preferred embodiment, the temperature of the wash bath at time t1 is between 12° C. and 45° C., preferably between 15° C. and 40° C. and in particular between 20° C. and 35° C., whereas the temperature of the wash bath at time t2 is preferably between 30° C. and 65° C., especially between 35° C. and 60° C. and in particular between 40° C. and 55° C.

At the time of metering of the cleaning agents A and B, the wash bath may have the same temperature or different temperatures. The temperature of the wash bath at time t1 is preferably different from the temperature of the wash bath at time t2, such that the temperature at time t1 may be higher or lower than the temperature at time t2. Especially advantageous cleaning results have been achieved in inventive processes in which the temperature of the wash bath at time t1 was lower than the temperature of the wash bath at time t2. Corresponding methods are therefore preferred.

To optimize the cleaning performance in the inventive process, the temperature of the wash bath at time t2 is preferably at least 5° C., especially at least 10° C. and in particular between 10° C. and 40° C., most especially, however, between 10° C. and 20° C. above the temperature of the wash bath at time t1.

Metering of the two liquid cleaning agents A and B takes place during the course of the cleaning cycle at two successive times t1 and t2, such that the cleaning agent A is metered at time t1 and cleaning agent B is metered at time t2, and time t1 occurs before time t2.

The time t1 is preferably within the first 10 minutes after the start of the cleaning cycle, preferably within the first 8 minutes after the start of the cleaning cycle and in particular within the first 5 minutes after the start of the cleaning cycle.

The difference in time between times t1 and t2 is preferably between 2 and 30 minutes, especially between 4 and 25 minutes and in particular between 6 and 20 minutes.

To optimize the cleaning performance in the inventive process, it is also provided that the pH of the cleaning agents A and B is kept within narrow limits. Preferred methods are characterized in that the cleaning agent A has a pH (20° C.) between 6.5 and 8.5, preferably between 7 and 8, while the pH (20° C.) of the cleaning agent B is between 9.5 and 13, preferably between 10 and 12.

In particular, preferred methods are those in which the pH (20° C.) of the liquid cleaning agent A differs from the pH (20° C.) of the liquid cleaning agent B by at least two units because especially good cleaning results can be obtained with these methods.

The cleaning agents A and B are preferably delivered out of an autarkic metering device into the interior of the dishwashing machine. "Autarkic" refers to a metering device that is not an integral component of the dishwashing machine used. Such a metering device preferably has its own storage container for cleaning agents A and B and has its own metering device for delivering and metering the cleaning agents A and B into the interior of the dishwashing machine. In an especially preferred embodiment, the metering device is also provided with an independent power supply.

The cleaning agents A and B may each be delivered into the interior of the dishwashing machine via an independent metering device. However, it is preferable for the cleaning agents A and B to be combined with one another in a shared metering device. Therefore, in a preferred embodiment, the liquid cleaning agents A and B are provided in a water-insoluble two-chamber or multi-chamber storage container. The cleaning agents A and B are preferably separated from one another spatially in this container and are metered out of this container into the interior of a dishwashing machine. Due to the separation of the cleaning agents from one another, physical and chemical interactions of the cleaning agents are suppressed.

The volume of the respective chambers of the storage container is preferably sufficient to hold at least five, preferably at least ten and especially preferably at least twenty metering units of a cleaning agent A and/or B. The metered quantity of the cleaning agents A and B is preferably between 5 mL and 50 mL, especially between 10 mL and 40 mL and in particular between 10 mL and 30 mL in the course of the cleaning process, so the preferred volume of the storage chambers for the cleaning agent A and/or the cleaning agent B is at least 25 mL, preferably at least 50 mL and in particular at least 100 mL. Metering devices having one chamber each for cleaning agents A and B are preferred, where the volume of each of these chambers is between 50 mL and 1000 mL, preferably between 100 mL and 800 mL and in particular between 200 mL and 600 mL.

It has surprisingly been found that the cleaning performance in the inventive process can also be influenced by the metering rate of the metering device in addition to the parameters mentioned above. The metering rate of the metering device is preferably between 1 mL and 40 mL per minute, especially between 2 mL and 30 mL per minute and in particular between 4 mL and 20 mL per minute.

The cleaning agents A and B used in the inventive process contain builders in addition to other detergent ingredients or those that have a cleaning effect. Builders include in particular zeolites, silicates, carbonates, organic cobuilders and, if there are no ecological objections to their use, also phosphates.

Crystalline sheet silicates of the general formula $NaMSi_xO_{2x+1}.yH_2O$ are especially preferred for use, where M denotes sodium or hydrogen, x is a number from 1.9 to 22, preferably from 1.9 to 4, especially preferred values for x being 2, 3 or 4, and y is a number from 0 to 33, preferably from 0 to 20. The crystalline sheet silicates of the formula $NaMSi_xO_{2x+1}.yH_2O$ are distributed by the company Clariant GmbH (Germany), for example, under the brand name Na-SKS. Examples of these silicates include Na-SKS-1 ($Na_2Si_{22}O_{45}.xH_2O$, kenyaite), Na-SKS-2 ($Na_2Si_{14}O_{29}.xH_2O$, magadiite), Na-SKS-3 ($Na_2Si_8O_{17}.xH_2O$) or Na-SKS-4 ($Na_2Si_4O_9.xH_2O$, makatite).

For the purposes of the present invention, crystalline sheet silicates of the formula $NaMSi_xO_{2x+1}.yH_2O$, in which x stands for 2, are especially suitable. In particular both β- and δ-sodium disilicates $Na_2Si_2O_5.yH_2O$ and also especially Na-SKS-5 ($\alpha$-$Na_2Si_2O_5$), Na-SKS-7 ($\beta$-$Na_2Si_2O_5$, natrosilite), Na-SKS-9 ($NaHSi_2O_5.H_2O$), Na-SKS-10 ($NaHSi_2O_5.3H_2O$, kanemite), Na-SKS-11 (t-$Na_2Si_2O_5$) and Na-SKS-13 ($NaHSi_2O_5$), but in particular Na-SKS-6 ($\delta$-$Na_2Si_2O_5$) are preferred.

The liquid cleaning agents A and/or B preferably contain an amount by weight of the crystalline sheet silicate of the formula $NaMSi_xO_{2x+1}.yH_2O$ of 0.1 wt % to 20 wt %, of 0.2 wt % to 15 wt % and in particular from 0.4 wt % to 10 wt %, each based on the weight of the respective cleaning agent A or B.

Amorphous sodium silicates with a modulus of $Na_2O:SiO_2$ of 1:2 to 1:3.3, preferably from 1:2 to 1:2.8 and in particular from 1:2 to 1:2.6 may also be used, preferably with delayed dissolving and having secondary washing properties. The delayed dissolving in comparison with traditional amorphous sodium silicates may be achieved in various ways, e.g., by surface treatment, compounding, compacting/compressing or overdrying. Within the context of the present invention, the term "amorphous" is understood to mean that the silicates do not yield any sharp X-ray reflexes in X-ray diffraction experiments, such as those typical of crystalline substances, but instead yield only one or more peaks of the scattered x-ray radiation having a width of several degree units of the diffraction angle.

Alternatively or in combination with the aforementioned amorphous sodium silicates, silicates that are amorphous to x-rays may be used, their silicate particles yielding blurred or even sharp diffraction peaks in the electron diffraction experiments. This is to be interpreted as indicating that the products have microcrystalline regions from ten nm to a few hundred nm in size, but values up to max. 50 nm and in particular up to max. 20 nm are preferred. Such x-ray-amorphous silicates also have delayed dissolving in comparison with the traditional water glasses. In particular compressed/compacted amorphous silicates, compounded amorphous silicates and overdried x-ray amorphous silicates are especially preferred.

Within the context of the present invention, it is preferable for this silicate (these silicates), preferably alkali silicates, especially preferably crystalline or amorphous alkali disilicates to be present in the liquid cleaning agent A and/or B in amounts of 2 wt % to 40 wt %, preferably from 3 wt % to 30 wt % and in particular from 5 wt % to 25 wt %, each based on the weight of the respective cleaning agent A or B.

Use of the widely known phosphates as builder substances is of course also possible if such a use should not be avoided for ecological reasons. Of the variety of commercially available phosphates, the alkali metal phosphates have gained the greatest importance in the detergent and cleaning agent industry, with special preference for pentasodium triphosphate and/or pentapotassium triphosphate (sodium tripolyphosphate and/or potassium tripolyphosphate).

Alkali metal phosphate is the general term for the alkali metal salts (in particular sodium and potassium) of the various phosphoric acids, where metaphosphoric acids $(HPO_3)_n$ and orthophosphoric acid $H_3PO_4$ can be differentiated in addition to higher molecular representatives. The phosphates combine several advantages: they act as alkali carriers, prevent lime deposits on machine parts and lime encrustations on fabrics and also contribute toward the cleaning performance.

Phosphates that are especially important industrially include pentasodium triphosphate $Na_5P_3O_{10}$ (sodium tripolyphosphate) and the corresponding potassium salt, pentapotassium triphosphate $K_5P_3O_{10}$ (potassium tripolyphosphate). In addition, sodium potassium tripolyphosphates are also preferred for use according to this invention.

If phosphates are used as detergent substances or as cleaning substances in the liquid cleaning agents A and/or B within the scope of the present patent application, then preferred combination products contain this phosphate (these phosphates), preferably alkali metal phosphate(s), especially preferably pentasodium triphosphate and/or potassium triphosphate (sodium tripolyphosphate and/or potassium tripolyphosphate) in amounts of 5 wt % to 60 wt %, preferably from 15 wt % to 45 wt % and in particular from 20 wt % to 40 wt %, each based on the weight of the respective cleaning agent A and/or B.

Organic cobuilders that may be mentioned include in particular polycarboxylates/polycarboxylic acids, polymeric polycarboxylates, aspartic acid, polyacetals, dextrins, other organic cobuilders and phosphonates. These classes of substances are described below.

Useable organic builder substances include, for example, the polycarboxylic acids that may be used in the form of the free acid and/or the sodium salts, where polycarboxylic acids are understood to be carboxylic acids having more than one acid function. Examples include citric acid, adipic acid, succinic acid, glutaric acid, malic acid, tartaric acid, maleic acid, fumaric acid, saccharic acids, aminocarboxylic acids, nitrilotriacetic acid (NTA) if such use is not objectionable for ecological reasons, as well as mixtures thereof. In addition to their builder effect, the free acids typically also have the property of an acidifying component and thus also serve to adjust a lower and milder pH of detergents or cleaning agents. In particular, citric acid, succinic acid, glutaric acid, adipic acid, gluconic acid and any mixtures thereof may be mentioned here.

Citric acid or salts of citric acid are especially preferably used here. Combination products, which are characterized in that the at least one of the cleaning agents A or B contains citric acid or a salt of citric acid and the amount by weight of the citric acid or the salt of citric acid, based on the total weight of the cleaning agent, is between 0.2 wt % and 12 wt %, preferably between 0.2 wt % and 8 wt % and in particular between 0.2 wt % and 6 wt %, are preferred according to this invention.

Another especially preferred builder substance is methylglycinediacetic acid (MGDA). Inventive processes which are characterized in that the cleaning agent contains methylglycinediacetic acid or a salt of methylglycinediacetic acid, and the amount by weight of the methylglycinediacetic acid or the salt of methylglycinediacetic acid is preferably between 0.2 wt % and 12 wt %, especially between 0.2 wt % and 8 wt % and in particular between 0.2 wt % and 6 wt %, are preferred according to the invention.

In addition, polymeric polycarboxylates are also suitable as builder substances; these include, for example, the alkali metal salts of polyacrylic or polymethacrylic acid, e.g., those with a relative molecular weight of 500 g/mol to 70,000 g/mol.

In the sense of the present invention, the molecular weights given for the polymeric polycarboxylates are weight-average molecular weights $M_W$ of the respective acid form, determined in principle by gel permeation chromatography (GPC) using a UV detector. The measurement was performed against an external polyacrylic acid standard that yielded realistic molecular weight values because of its structural relationship to the polymers tested. These values deviate significantly from the molecular weight values using polystyrene sulfonic acids as the standard. The molecular weights measured against polystyrene sulfonic acids are usually much higher than the molecular weights given in the present document.

Suitable polymers include in particular polyacrylates, which preferably have a molecular weight of 2000 g/mol to 20,000 g/mol. From this group, the short-chain polyacrylates having molecular weights of 2000 g/mol to 10,000 g/mol and especially preferably from 3000 g/mol to 5000 g/mol may be preferred because of their superior solubility.

Also suitable are copolymeric polycarboxylates, in particular those of acrylic acid with methacrylic acid and acrylic acid or methacrylic acid with maleic acid. Copolymers of acrylic acid with maleic acid containing 50 wt % to 90 wt % acrylic acid and 50 wt % to 10 wt % maleic acid have proven to be especially suitable. Their relative molecular weight, based on free acids, is generally 2000 g/mol to 70,000 g/mol, preferably 20,000 g/mol to 50,000 g/mol and in particular 30,000 g/mol to 40,000 g/mol.

The (co)polymeric carboxylate content in detergents or cleaning agents preferably amounts to 0.1 wt % to 10 wt %, especially 0.2 wt % to 8 wt %, especially preferably 0.4 wt % to 6 wt % and in particular between 0.4 wt % and 4 wt %.

To improve the water solubility, the polymers may also contain allylsulfonic acids, e.g., allyloxybenzenesulfonic acid and methallylsulfonic acid as monomers.

Biodegradable polymers of more than two different monomer units, e.g., those containing as monomers the salts of acrylic acid and maleic acid as well as vinyl alcohol and/or vinyl alcohol derivatives or containing as monomers the salts of acrylic acid and 2-alkylallylsulfonic acid as well as sugar derivatives are especially preferred.

Additional preferred copolymers are those containing as monomers preferably acrolein and acrylic acid/acrylic acid salts and/or acrolein and vinyl acetate.

Likewise, polymeric aminodicarboxylic acids, their salts or their precursor substances may be mentioned as additional preferred builder substances. Polyaspartic acids and/or their salts are especially preferred.

Other suitable builder substances include polyacetals that can be obtained by reaction of dialdehydes with polyolcarboxylic acids having five to seven carbon atoms and at least three hydroxyl groups. Preferred polyacetals are obtained from dialdehydes, such as glyoxal, glutaraldehyde, terephthalaldehyde and mixtures thereof and from polyol carboxylic acids such as gluconic acid and/or glucoheptonic acid.

Additional suitable organic builder substances include dextrins, e.g., oligomers and/or polymers of carbohydrates, which may be obtained by partial hydrolysis of starches. The hydrolysis may be performed by conventional methods, e.g., acid-catalyzed or enzyme-catalyzed processes. These are preferably hydrolysis products having average molecular weights in the range of 400 g/mol to 500,000 g/mol. A polysaccharide having a dextrose equivalent (DE) in the range of 0.5 to 40, in particular from 2 to 30, is preferred, where DE is a usable measure for the reducing effect of a polysaccharide in comparison with dextrose, which has a DE of 100. Maltodextrins having a DE between 3 and 20 and dry glucose syrup with a DE between 20 and 37 as well as so-called yellow dextrins and white dextrins having higher molecular weights in the range of 2000 g/mol to 30,000 g/mol may also be used.

The oxidized derivatives of such dextrins include their reaction products with oxidizing agents capable of oxidizing at least one alcohol function of the saccharide ring to the carboxylic acid function.

Oxydisuccinates and other derivatives of disuccinates, preferably ethylenediaminedisuccinate are other suitable cobuilders. Ethylenediamine-N,N'-disuccinate (EDDS) is preferably used in the form of its sodium or magnesium salts. Also preferred in this context are glycerol disuccinates and glycerol trisuccinates.

Other usable organic cobuilders include, for example, acetylated hydroxycarboxylic acids and/or their salts, which may optionally also be present in lactone form and which contain at least four carbon atoms and at least one hydroxyl group plus a maximum of two acid groups.

In addition, all compounds capable of forming complexes with alkaline earth ions may also be used as builder substances.

The composition used as cleaning agent A in the inventive process contains enzymes as an additional component. These include in particular proteases, amylases, lipases, hemicellulases, cellulases or oxidoreductases as well as preferably their mixtures. These enzymes are in principle of natural origin; starting from the natural molecules, variants that have been improved are available for use in detergents and cleaning agents and are preferably used accordingly. Detergents or cleaning agents preferably contain enzymes in total amounts of $1\times10^{-6}$ wt % to 5 wt %, based on active protein. The protein concentration may be determined with the help of known methods, e.g., the BCA method or the biuret method.

Of the proteases, those of the subtilisin type are preferred. Examples include subtilisins BPN' and Carlsberg as well as their further developed forms, namely protease PB92, subtilisins 147 and 309, the alkaline protease from *Bacillus lentus*, subtilisin DY and the enzymes thermitase, proteinase K and proteases TW3 and TW7, which are to be assigned to the subtilases but no longer to the subtilisins in the narrower sense.

Examples of amylases that may be used according to the invention include the α-amylases from *Bacillus licheniformis*, from *B. amyloliquefaciens*, from *B. stearothermophilus*, from *Aspergillus niger* and from *A. oryzae* as well as the further developments of the aforementioned amylases that have been improved for use in detergents and cleaning agents. In addition, the α-amylase from *Bacillus* sp. A 7-7 (DSM 12368) and the cyclodextrin glucanotransferase (CGTase) from *B. agaradherens* (DSM 9948) are to be emphasized for this purpose.

An α-amylase variant that can be obtained either from a starting α-amylase that is homologizable with α-amylase AA560, via amino acid changes in the following positions: 9, 149, 182, 186, 202, 257, 295, 299, 323, 339, 345 and optionally others (in the list according to α-amylase AA560) or from α-amylase AA560 via the following amino acid changes has proven to be especially suitable for use in the inventive process:

(1) M9L/M202I,
(2) M9L/M202I/M323T,
(3) M9L/M202I/M323T/M382Y,
(4) M9L/M202I/Y295F/A339S,
(5) M9L/M202I/Y295F,
(6) M9L/M202I/A339S,
(7) M9L/M202I/Y295F/A339S,
(8) M9L/M202I/Y295F/A339S/E345R,
(9) M9L/G149A/M202I/Y295F/A339S/E345R,
(10) M9L/M202L,
(11) M9L/M202L/M323T,
(12) M9L/M202L/M323T/M382Y,
(13) M9L/M202L/Y295F/A339S,
(14) M9L/M202L/Y295F,
(15) M9L/M202L/A339S,
(16) M9L/M202L/Y295F/A339S,
(17) M9L/M202L/Y295F/A339S, E345R,
(18) M9L/G149A/M202L/Y295F/A339S/E345R,
(19) M9L/M202T,
(20) M9L/M202T/M323T,
(21) M9L/M202T/M323T/M382Y,
(22) M9L/M202T/Y295F/A339S,
(23) M9L 1 M202T/Y295F,
(24) M9L/M202T/A339S,
(25) M9L/M202T/Y295F/A339S,
(26) M9L/M202T/Y295F/A339S/E345R,
(27) M9L/G149A/M202T/Y295F/A339S/E345R,
(28) M9L/G149A/M202I/V214T/Y295F/N299Y/M323T/A339S/E345R,
(29) M9L/G149A/M202L/V214I/Y295F/M323T/A339S/E345R/M382Y,
(30) M9L/G149A/G182T/G186A/M202I/V214I/Y295F/N299Y/M323T/A339S,
(31) M9L/G149A/G182T/G186A/M202L/T257I/Y295F/N299Y/M323T/A339S/E345R,
(32) M9L/G149A/M202L/V214T/Y295F/N299Y/M323T/A339S/E345R,
(33) M9L/G149A/M202I/V214I/Y295F/M323T/A339S/E345R/M382Y,
(34) M9L/G149A/G182T/G186A/M202L/V214I/Y295F/N299Y/M323T/A3398,
(35) M9L/G149A/G182T/G186A/M202I/T257I/Y295F/N299Y/M323T/A339S/E345R,
(36) M9L/G149A/M202I/V214T/Y295F/N299Y/M323T/A339S/E345R/N471E,
(37) M9L/G149A/M202L/V214I/Y295F/M323T/A339S/E345R/M382Y/N471E,
(38) M9L/G149A/G182T/G186A/M202I/V214I/Y295F/N299Y/M323T/A339S/N471E,
(39) M9L/G149A/G182T/G186A/M202L/T257I/Y295F/N299Y/M323T/A339S/E345R/N471E,
(40) M202L/M105F/M208F,
(41) G133E/M202L/Q361E,
(42) G133E/M202L/R444E,
(43) M202L/Y295F,
(44) M202L/A339S,
(45) M202L/M323T,
(46) M202L/M323T/M309L,
(47) M202L/M323T/M430I,
(48) M202L/V214T/R444Y,
(49) M202L/N283D/Q361E,
(50) M202L/M382Y/K383R,
(51) M202L K446R/N484Q,
(52) M202I/Y295F,
(53) M202I/A339S,
(54) M202I/M105F/M208F,
(55) G133E/M202I/Q361E,
(56) G133E/M202I/R444E,
(57) M202I/M323T,

(58) M202I/M323T/M309L,
(59) M202I/M323T/M430I,
(60) M202I/V214T/R444Y,
(61) M202I/N283D/Q361E,
(62) M202I/M382Y/K383R,
(63) M202I/K446R/N484Q,
(64) M202V/M105F/M208F,
(65) G133E/M202V/Q361E,
(66) G133E/M202V/R444E,
(67) M202V/M323T,
(68) M202V/M323T/M309L,
(69) M202V/M323T/M430I,
(70) M202V/M323T/M9L,
(71) M202V/V214T/R444Y,
(72) M202V/N283D/Q361E,
(73) M202V/M382Y/K383R,
(74) M202V/K446R/N484Q,
(75) M202T/M105F/M208F,
(76) G133E/M202T/Q361E,
(77) G133E/M202T/R444E,
(78) M202T/Y295F,
(79) M202T/A339S,
(80) M202T/M323T,
(81) M202T/M323T/M309L,
(82) M202T/M323T/M430I,
(83) M202T/M323T/M9L,
(84) M202T/V214T/R444Y,
(85) M202T/N283D/Q361E,
(86) M202T/A339S,
(87) M202T/Y295F
(88) M202T/N299F,Y,
(89) M202T/M382Y/K383R or
(90) M202T/K446R/N484Q

The α-amylase variant is especially preferably characterized by one or more additional amino acid changes in the following positions in comparison with a starting α-amylase homologizable with α-amylase AA560: 118, 183, 184, 195, 320 and 458 (in the list according to α-amylase AA560), where the α-amylase variant preferably has the following amino acid positions occupied in particular: 118K, 183- (deletion), 184- (deletion), 195F, 320K and/or 458K (in the list according to α-amylase AA560).

An α-amylase variant which can be derived from α-amylase AA560 or a derivative thereof and preferably has been derived from α-amylase AA560 itself is especially preferred. In particular, such cleaning agents that are used according to the present invention and contain an α-amylase variant having one of the following amino acid changes in comparison with α-amylase AA560 are especially preferred:

(10) M9L/M202L,
(28) M9L/G149A/M202I/V214T/Y295F/N299Y/M323T/A339S/E345R,
(31) M9L/G149A/G182T/G186A/M202L/T257I/Y295F/N29Y/M323T/A339S/E345R,
(35) M9L/G149A/G182T/G186A/M202I/T257I/Y295F/N299Y/M323T/A339S/E345R,
(38) M9L/G149A/G182T/G186A/M202I/V214I/Y295F/N299Y/M323T/A339S/N471E,
(39) M9L/G149A/G182T/G186A/M202L/T257I/Y295F/N299Y/M323T/A339S/E345R N471E,
(45) M202L/M323T,
(4) M202L/M323T/M309L,
(62) M202I/M382Y/K383R,
(68) M202V/M323T/M309L,
(73) M202V/M382Y/K383R
(82) M202T/M323T/M430I
(84) M202T/V214T/R444Y.

The aforementioned preferred α-amylase variants have distinguished themselves by an above-average stability in storage and cleaning performance, in particular when used in storage and metering via automatic metering systems, which hold enough cleaning agent for several cleaning cycles; this is why these cleaning agents may be stored for long periods of time in these metering systems.

As a supplement to the α-amylase variant described above, the cleaning agent preferred for use according to the present invention contains a protease, preferably a subtilisin protease, whereby the subtilisin protease is a wild-type protease or a protease variant, and the protease variant is preferably one having an amino acid change in one or more of the following positions: 3, 4, 36, 42, 43, 47, 56, 61, 69, 87, 96, 99, 101, 102, 104, 114, 118, 120, 130, 139, 141, 142, 154, 157, 188, 193, 199, 205, 211, 224, 229, 236, 237, 242, 243, 250, 253, 255 and 268, in the list of alkaline protease from *Bacillus lentus*, in comparison with a starting protease homologizable with the alkaline protease from *Bacillus lentus*

In addition, lipases or cutinases may also be used according to the invention, in particular because of their triglyceride-cleaving activities but also to create peracids from suitable precursors in situ. These include, for example, the lipases originally accessible from *Humicola lanuginosa* (*Thermomyces lanuginosus*) and/or lipases that have been developed further, in particular those with the amino acid exchange D96L. Furthermore, the cutinases originally isolated from *Fusarium solani pisi* and *Humicola insolens* may also be used. Furthermore, lipases and/or cutinases whose starting enzymes were originally isolated from *Pseudomonas mendocina* and *Fusarium solanii* may also be used.

In addition, enzymes combined under the term hemicellulases may also be used. These include, for example, mannases, xanthan lyases, pectin lyases (=pectinases), pectin esterases, pectate lyases, xyloglucanases (=xylanases), pullulanases and β-glucanases.

To increase the bleaching effect, oxidoreductases, e.g., oxidases, oxygenases, catalases, peroxidases such as haloperoxidase, chloroperoxidase, bromoperoxidase, lignin peroxidase, glucose peroxidase or manganese peroxidase, dioxygenases or laccases (phenol oxidases, polyphenol oxidases) may also be used according to the invention. In addition, preferably organic compounds, especially preferably aromatic compounds that interact with the enzymes may advantageously be added to increase (enhance) the activity of the respective oxidoreductases (enhancers) or to ensure the electron flow when there is a great difference in redox potentials between the oxidizing enzymes and the soiling (mediators).

The enzymes may be used in any form established according to the state of the art. These include, for example, the solid preparations obtained by granulation, extrusion or lyophilization, or in the case of liquid or gelatinous agents in particular, solutions of the enzymes, advantageously as concentrated as possible, with a low water content and/or mixed with stabilizers.

Alternatively, for both the liquid and solid forms of administration, the enzymes may be encapsulated, e.g. by spray drying or extrusion of the enzyme solution together with a preferably natural polymer or in the form of capsules, e.g., those in which the enzymes are enclosed, as in a solidified gel or in those of the core-shell type in which a core containing enzyme is coated with a protective layer impermeable to water, air and/or chemicals. In stacked layers, other active ingredients, e.g. stabilizers, emulsifiers, pigments, bleaches or pigments may also be applied. Such capsules are applied by essentially known methods, e.g. by shaking granulation or rolling granulation or in fluidized bed processes. Such granules advantageously have a low dust burden, e.g., due to the application of polymeric film-forming agents, and are stable in storage due to the coating.

In addition, it is possible to fabricate two or more enzymes together so that a single granule comprises multiple enzyme activities.

A protein and/or enzyme may be protected against damage, e.g. due to inactivation, denaturing or disintegration during storage, e.g. due to physical influences, oxidation or proteolytic cleavage. In microbial production of proteins and/or enzymes, inhibition of proteolysis is especially preferred, in particular when the agents also contain proteases. Detergents or cleaning agents may contain stabilizers for this purpose; providing such agents constitutes a preferred embodiment of the present invention.

A protein and/or enzyme contained in an inventive agent may be protected especially during storage against damage such as inactivation, denaturing or disintegration, e.g. due to physical influences, oxidation or proteolytic cleavage, especially during storage. In microbial production of proteins and/or enzymes, inhibition of proteolysis is especially preferred, in particular when the agents also contain proteases. Preferred inventive agents contain stabilizers for this purpose.

One group of stabilizers comprises reversible protease inhibitors. Benzamidine hydrochloride, borax, boric acids, boronic acids or the salts or esters thereof are often used for this purpose, including especially derivatives with aromatic groups, e.g., ortho-, meta- or para-substituted phenylboronic acids, in particular 4-formylphenylboronic acid and/or the salts or esters of the aforementioned compounds. Peptide aldehydes, i.e. oligopeptides with a reduced C terminus, in particular those comprising 2 to 50 monomers, are used for this purpose. Peptidic reversible protease inhibitors include, among others, ovomucoid and leupeptin. Specific reversible peptide inhibitors for the protease subtilisin as well as fusion proteins of proteases and specific peptide inhibitors are suitable for this purpose.

Other enzyme stabilizers are amino alcohols such as mono-, di-, triethanolamine and -propanolamine and mixtures thereof, aliphatic carboxylic acids up to $C_{12}$ such as succinic acid, other dicarboxylic acids or salts of the aforementioned acids. End group-capped fatty acid amide alkoxylates are also suitable for this purpose. Certain organic acids used as builders are additionally capable of stabilizing an enzyme ingredient, as disclosed in WO 97/18287.

Low aliphatic alcohols, but especially polyols, e.g. glycerol, ethylene glycol, propylene glycol or sorbitol are additional enzyme stabilizers that are often used. Diglycerol phosphate protects against denaturing due to physical influences. Likewise, calcium and/or magnesium salts are used, e.g., calcium acetate or calcium formate.

Polyamide oligomers or polymer compounds such as lignin, water-soluble vinyl copolymers or cellulose ethers, acrylic polymers and/or polyamides stabilize the enzyme preparation against physical influences or fluctuations in pH, among other things. Polymers containing polyamine N-oxide function simultaneously as enzyme stabilizers and as dye transfer inhibitors. Other polymer stabilizers include linear $C_8$-$C_{18}$ polyoxyalkylenes. Alkylpolyglycosides are also able to stabilize the enzymatic components of the inventive agent and are preferably able to additionally increase their efficiency. Crosslinked compounds containing nitrogen preferably fulfill a double function as soil release agents and as enzyme stabilizers. Hydrophobic nonionic polymer stabilizes in particular a cellulase, which is optionally also present.

Reducing agents and antioxidants increase the stability of the enzymes with respect to oxidative decomposition; reducing agents that contain sulfur, for example, are commonly used for this purpose. Other examples include sodium sulfite and reducing sugars.

Combinations of stabilizers are especially preferably used, e.g., combinations of polyols, boric acid and/or borax, the combination of boric acid or borate, reducing salts and succinic acid or other dicarboxylic acids or the combination of boric acid or borate with polyols or polyamino compounds with reducing salts. The effect of peptide aldehyde stabilizers is advantageously increased by combination with boric acid and/or boric acid derivatives and polyols and even further by the additional effect of divalent cations, e.g., calcium ions.

Potassium sulfate ($K_2SO_4$) is another agent that is especially preferably used to stabilize the enzymatic preparations.

As stated in the introduction, the amount by weight of the enzymes in the total weight of the liquid cleaning agent A is between 0.1 wt % and 10 wt %. In especially preferred combination products, the amount by weight of the enzyme in the total weight of cleaning agent A is between 0.2 wt % and 9 wt % and in particular between 0.5 wt % and 8 wt %.

Although the liquid cleaning agent B may of course also contain enzymes, it is preferable for the enzyme content of the cleaning agent B to be less than 2 wt %, preferably less than 1 wt %, especially preferably less than 0.5 wt % and in particular less than 0.1 wt %. Especially preferred inventive processes are characterized in that the liquid cleaning agent B does not contain any enzymes.

Preferably one or more enzymes and/or enzyme preparations, especially solid or liquid protease preparations and/or amylase preparations are used. In an especially preferred embodiment, the liquid cleaning agent A contains a combination of proteases preparations and amylase preparations.

As an additional component, the cleaning agents A and B used in the inventive process contain a solvent. In the simplest embodiment, this solvent is only water. Preferred methods are those in which the liquid cleaning agent A and/or the liquid cleaning agent B contains water as the solvent.

It has surprisingly been found that in an inventive process, the cleaning performance can be improved by adding organic solvents. Therefore, the preferred subject matter of the present patent application is an inventive process in which at least one of the cleaning agents A or B also contains an organic solvent, such that the organic solvent may be used alone, as a mixture of several organic solvents or as a mixture of one or more organic solvents with water.

Preferred organic solvents come from the groups of monoalcohols, diols, triols and/or polyols, ethers, esters and/or amides, for example. Especially preferred here are organic solvents which are water-soluble, where "water-soluble" solvents in the sense of the present patent applications are solvents that are completely miscible with water at room temperature, i.e., without a miscibility gap.

Organic solvents that may be used in the inventive process preferably come from the group of monovalent or polyvalent alcohols, alkanolamines or glycol ethers if they are miscible with water in the stated concentration range. The solvents are preferably selected from ethanol, n- or isopropanol, butanols, glycol, propanediol or butanediol, glycerol, diglycol, propyl or butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl, ethyl or propyl ether, dipropylene glycol methyl or ethyl ether, methoxy, ethoxy or butoxy triglycol, 1-butoxy-ethoxy-2-propanol, 3-methyl-3-methoxybutanol, propylene glycol-t-butyl ether as well as mixtures of these solvents.

Organic solvents from the group of organic amines and/or alkanolamines have been proven to be especially effective with regard to cleaning performance and here in turn with regard to the cleaning performance on bleachable soiling, in particular on tea stains.

Preferred organic amines are in particular the primary and secondary alkylamines, alkyleneamines and mixtures of these organic amines. Monomethylamine, monoethylamine, monopropylamine, monobutylamine, monopentylamine and cyclohexylamine belong to the group of preferred primary amines. Dimethylamine in particular belongs to the group of preferred secondary alkylamines.

Preferred alkanolamines include in particular the primary, secondary and tertiary alkanolamines as well as mixtures thereof. Especially preferred primary alkanolamines are monoethanolamine (2-aminoethanol, MEA), monoisopropanolamine, diethylethanolamine (2-(diethylamino)ethanol). Especially preferred secondary alkanolamines are diethanolamine (2,2'-iminodiethanol, DEA, bis(2-hydroxyethyl)amine), N-methyldiethanolamine, N-ethyldiethanolamine, diisopropanolamine and morpholine. Especially preferred tertiary alkanolamines are triethanolamine and triisopropanolamine.

Especially efficient variants of the method are characterized in that the liquid cleaning agent A and/or the liquid cleaning agent B contain(s) a solvent form the group of organic solvents, such that the organic solvent is preferably an organic amine and/or an alkanolamine, preferably ethanolamine.

If the cleaning agents A and/or B also contain water in addition to the organic amine, then such inventive processes in which the weight ratio of water to organic amine and/or alkanolamine in the cleaning agent A or B is more than 1:1, preferably more than 2:1 and in particular more than 5:1 are preferred.

Another subject matter of this patent application is the use of organic amines, in particular the aforementioned organic amines and/or alkanolamines in an inventive process for cleaning bleachable soiling, preferably for cleaning tea stains on hard surfaces.

Especially preferred cleaning agents A and/or B are those containing between 0.1 wt % and 10 wt %, preferably between 0.5 wt % and 8 wt % and in particular between 1.5 wt % and 6 wt %, based on the total weight of the respective cleaning agent, of an organic solvent from the group of organic amine and alkanolamines. Inventive processes in which the liquid cleaning agent B contains an amount by weight of an organic solvent from the group of organic amines and alkanolamines between 0.1 wt % and 10 wt %, preferably between 0.5 wt % and 8 wt % and in particular between 1.5 wt % and 6 wt %, based on the total weight of cleaning agent B, while the amount by weight of organic solvent from the group of organic amines and alkanolamines in the liquid cleaning agent A, based on the total weight of the cleaning agent A, is preferably less than 5 wt %, especially less than 3 wt %, especially preferably less than 1 wt % and most especially preferably less than 0.1 wt % and in particular no organic solvent from the group of organic amines and alkanolamines is present in the cleaning agent A.

With regard to their meterability in the course of the inventive cleaning method, cleaning agents having a viscosity of more than 10,000 mPas, preferably more than 50,000 mPas and in particular more than 100,000 mPas have proven to be advantageous.

Therefore, methods preferred according to the invention are those in which the viscosity (Brookfield viscometer LVT-II at 20 rpm and 20° C., spindle 3) of at least one of the cleaning agents A or B is between 200 mPas and 10,000 mPas, preferably between 500 mPas and 7000 mPas and in particular between 1000 mPas and 4000 mPas. The viscosity (Brookfield viscometer LVT-II at 20 rpm and 20° C., spindle 3) of especially preferred detergents or cleaning agents is greater than 500 mPas, preferably above 1000 mPas and in particular greater than 2000 mPas.

To achieve the desired viscosity of the cleaning agents, thickeners are preferably added to these agents, in particular thickeners from the group of agar, carrageen, gum tragacanth, gum arabic, alginates, pectins, polyoses, guar powder, carob bean powder, starch, dextrins, gelatin, casein, carboxymethyl cellulose, carob gum ether, polyacryl and polymethacryl compounds, vinyl polymers, polycarboxylic acids, polyethers, polyimines, polyamides, polysilicic acids, clay minerals such as montmorillonite, zeolites and silicic acids, and it has proven especially advantageous if the cleaning agents contain the thickeners in amount between 0.1 wt % and 8 wt %, preferably between 0.2 wt % and 6 wt % and especially preferably between 0.4 wt % and 4 wt %, based on the total weight of the cleaning agent.

Naturally occurring polymers that may be used as thickeners within the context of the present invention include, for example, as described above, agar, carrageenan, gum tragacanth, gum arabic, alginates, pectins, polyoses, guar powder, carob bean powder, starch, dextrins, gelatin and casein.

Modified natural substances originate mainly from the group of modified starches and celluloses, e.g., carboxymethyl cellulose and other cellulose ethers, hydroxyethyl cellulose and hydroxypropyl cellulose as well as carob gum ether.

A large group of thickeners that are widely used in a wide variety of fields of application includes the fully synthetic polymers such as polyacryl and polymethacryl compounds, vinyl polymers, polycarboxylic acids, polyethers, polyimines, polyamides and polyurethanes. Thickeners from these classes of substances are widely available commercially and are distributed, for example, under the brand names Acusol® 820 (methacrylic acid (stearyl alcohol 20-EO) ester-acrylic acid copolymer, 30% in water, Rohm & Haas), Dapral® GT-282-S (alkylpolyglycol ether, Akzo), Deuterol® Polymer 11 (dicarboxylic acid copolymer, Schöner GmbH), Deuteron® XG (anionic heteropolysaccharide based on β-D-glucose, D-mannose, D-glucuronic acid, Schöner GmbH), Deuteron® XN (nonionic polysaccharide, Schöner GmbH), Dicrylan® thickener O (ethylene oxide adduct, 50% in water/isopropanol, Pfersse Chemie), EMA® 81 and EMA® 91 (ethylene-maleic anhydride copolymer, Monsanto), thickener QR 1001 (polyurethane emulsion, 19-21% in water/diglycol ether, Rohm & Haas), Mirox® AM (anionic acrylic acid-acrylic acid ester copolymer dispersion, 25% in water, Stockhausen), SER-AD-FX 1100 (hydrophobic urethane polymer, Servo Delden), Shellflo® S (high-molecular polysaccharide stabilized with formaldehyde, Shell), and Shellflo® XA (xanthan biopolymer stabilized with formaldehyde, Shell).

The inventive cleaning agents may also contain bleaching agents; it is possible to differentiate between two preferred variants with regard to the bleaching agent content of the cleaning agents A and B.

In a first preferred embodiment, the bleaching agent content of the liquid cleaning agents A and B is selected to be low, preferably amounting to less than 2 wt %. Through the inventive process management and also through the use of cleaning agents having a low bleaching agent content, it has surprisingly been possible to achieve a cleaning performance comparable to that achieved with the cleaning agents containing bleach. However, freedom with regard to the formulation has been increased, while at the same time lowering production costs by omitting the bleaching agents.

Inventive processes which are characterized in that the bleaching agent content of cleaning agents A and B is less than 2 wt % each, preferably less than 1 wt %, especially less than 0.5 wt % and in particular less than 0.1 wt %, are preferred for this reason. Especially preferred are the inventive processes in which the cleaning agents A and B do not contain any bleaching agent.

In a second preferred embodiment, cleaning agents A and/or B contain bleaching agents, such that those methods in which cleaning agent B has a bleaching agent content between 0.1 wt % and 15 wt % are preferred in particular. Preferred methods are characterized in that the bleaching agent content of the cleaning agent B, each based on the total weight of the cleaning agent B, is between 0.5 wt % and 15 wt %, preferably between 2.0 wt % and 15 wt %, especially preferably between 3 wt % and 12 wt % and in particular between 5 wt % and 10 wt %. The bleaching agent content of the cleaning agent A in this embodiment is preferably less than 2 wt %, especially less than 1 wt %, preferably less than 0.5 wt % and in particular less than 0.1 wt %. Especially preferred methods are characterized in that the cleaning agent A does not contain any bleaching agent.

In addition to $H_2O_2$, the compounds that yield $H_2O_2$ in water, namely sodium percarbonate, sodium perborate tetrahydrate and sodium perborate monohydrate belong to the group of bleaching agents. Other bleaching agents include, for example, peroxypyrophosphates, citrate perhydrates and peracid salts that supply $H_2O_2$ or peracids such as perbenzoates, peroxophthalates, diperazelaic acid, phthaloimino peracid or diperdodecane diacid.

Typical organic bleaching agents include the diacyl peroxides, e.g., dibenzoyl peroxide. Other typical organic bleaching agents include the peroxy acids; alkylperoxy acids and arylperoxy acids are mentioned in particular as examples. Preferred representatives include (a) peroxybenzoic acid and its ring-substituted derivatives, such as alkylperoxybenzoic acids as well as peroxy-α-naphthoic acid and magnesium monoperphthalate, (b) the aliphatic or substituted, aliphatic peroxy acids such as peroxylauric acid, peroxystearic acid, ε-phthalimidoperoxycaproxic acid (phthaliminoperoxyhexanoic acid (PAP)), o-carboxybenzamidoperoxycaproic acid, N-nonenylamidoperadipic acid and N-nonenylamidopersuccinate and (c) aliphatic and araliphatic peroxydicarboxylic acids, such as 1,12-diperoxycarboxylic acid, 1,9-diperoxyazelaic acid, diperoxysebacic acid, diperoxybrassylic acid, diperoxyphthalic acids, 2-decyldiperoxybutane-1,4-dioic acid, N,N-terephthaloyl-di-(6-aminopercaproic acid).

If cleaning agents A and/or B contain bleaching agents, then bleach activators are preferably also added to achieve an improved bleaching effect in cleaning at temperature of 60° C. or less. Bleach activators that may be used include compounds that yield aliphatic peroxycarboxylic acids preferably with one to ten carbon atoms, in particular two to four carbon atoms under perhydrolysis conditions and/or optionally substituted perbenzoic acid. Substances having O-acyl groups and/or N-acyl groups with the stated number of carbon atoms and/or optionally substituted benzoyl groups are also suitable. Polyacylated alkylenediamines are preferred, in particular tetraacetylethylenediamine (TAED), acylated triazine derivatives, in particular 1,5-diacetyl-2,4-dioxo-hexahydro-1,3,5-triazine (DADHT), acylated glycolurils, in particular tetra-acetylglycoluril (TAGU), N-acylimides, in particular N-nonanoylsuccinimide (NOSI), acylated phenol sulfonates, in particular n-nonanoyloxybenzenesulfonate or isononanoyloxybenzenesulfonate (n-NOBS and/or iso-NOBS), carboxylic acid anhydrides, in particular phthalic acid anhydride, acylated polyvalent alcohols, in particular triacetin, ethylene glycol diacetate and 2,5-diacetoxy-2,5-dihydrofuran. Other bleach activators that are preferably used within the context of the present invention include compounds from the group of cationic nitriles, in particular cationic nitriles of the formula

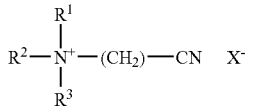

in which $R^1$ stands for H, $CH_3$, a $C_{2-24}$ alkyl or alkenyl radical, a substituted $C_{2-24}$ alkyl or alkenyl radical with at least one substituents from the group Cl, Br, OH, $NH_2$, CN, an alkyl or alkenylaryl radical with a $C_{1-24}$ alkyl group or stands for a substituted alkyl or alkenylaryl radical with a $C_{1-24}$ alkyl group and at least one additional substituent on the aromatic ring, $R^2$ and $R^3$ independently of one another are selected from —$CH_2$—CN, —$CH_3$, —$CH_2$—$CH_3$, —$CH_2$—$CH_2$—$CH_3$, —CH($CH_3$)—$CH_3$, —$CH_2$—OH, —$CH_2$—$CH_2$—OH, —CH(OH)—$CH_3$, —$CH_2$—$CH_2$—$CH_2$—OH, —$CH_2$—CH(OH)—$CH_3$, —CH(OH)—$CH_2$—$CH_3$, —($CH_2CH_2$—O)$_n$H, where n=1, 2, 3, 4, 5 or 6 and X is an anion.

Especially preferred is a cationic nitrile of the formula

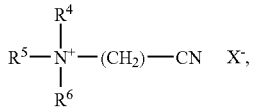

in which $R^4$, $R^5$ and $R^6$ independently of one another are selected from —$CH_3$, —$CH_2$—$CH_3$, —$CH_2$—$CH_2$—$CH_3$, —CH($CH_3$)—$CH_3$, where $R^4$ may also be H and X is an anion, where preferably $R^5$=$R^6$=—$CH_3$ and in particular $R^4$=$R^5$=$R^6$=—$CH_3$ and compounds of the formulas $(CH_3)_3N^{(+)}CH_2$—CH $X^-$, $(CH_3CH_2)_3N^{(+)}CH_2$—CN $X^-$, $(CH_3CH_2CH_2)_3N^{(+)}CH_2$—CN $X^-$, $(CH_3CH(CH_3))_3N^{(+)}CH_2$—CN $X^-$ or $(HO—CH_2—CH_2)_3N^{(+)}CH_2$—CN $X^-$ are especially preferred, whereby again the cationic nitrile of the formula $(CH_3)_3N^{(+)}CH_2$—CN $X^-$ in which $X^-$ stands for an anion selected from the group of chloride, bromide, iodide, bisulfate, methosulfate, p-toluenesulfonate (tosylate) or xylenesulfonate is especially preferred from the group of these substances.

The bleaching activators may be compounds that yield aliphatic peroxocarboxylic acids with preferably one to ten carbon atoms, in particular two to four carbon atoms and/or optionally substituted perbenzoic acid under perhydrolysis conditions. Suitable substances are those having O- and/or N-acyl groups with the stated number of carbon atoms and/or optionally substituted benzoyl groups. Preferred are the polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetra-acetylglycoluril (TAGU), N-acylimides, in particular N-nonanoylsuccinimide (NOSI), acylated phenol sulfonates, in particular n-nonanoyl- or isononanoyl-oxybenzenesulfonate (n- and/or iso-NOBS), carboxylic acid anhydrides, in particular phthalic acid anhydride, acylated polyvalent alcohols, in particular triacetin, ethylene glycol diacetate, 2,5-diacetoxy-2,5-dihydrofuran, n-methylmorpholinium acetonitrile methyl sulfate (MMA) and acetylated sorbitol and mannitol and/or mixtures thereof (SORMAN), acylated sugar derivatives, in particular pentaacetyl glucose (PAG), pentaacetyl fructose, tetraacetyl xylose and octaacetyl lactose as well as acylated, optionally N-alkylated glucamine and gluconolactone and/or N-acylated lactams, e.g., N-benzoylcaprolactam. Acylacetals and acyllactams having hydrophilic substituents are also preferred for use. Combinations of conventional bleach activators may also be used.

If additional bleach activators in addition to the nitrile quats are to be used, then preferably bleach activators from the group of polyacylated alkylenediamines, in particular tetraacetylethylenediamine (TAED), N-acylimides, in particular N-nonanoylsuccinimide (NOSI), acylated phenol sulfonates, in particular n-nonanoyl- or isononanoyl-oxybenzenesulfonate (n- and/or iso-NOBS), n-methylmorpholinium acetonitrile methyl sulfate (MMA) are preferably used.

In addition to or instead of the conventional bleach activators, so-called bleach catalysts may also be used. These substances are transition metal salts and/or transition metal complexes that enhance the bleaching effect, e.g., Mn-, Fe-, Co-, Ru- or Mo-saline complexes or carbonyl complexes. Also Mn, Fe, Co, Ru, Mo, Ti, V and Cu complexes with N-containing tripod ligands as well as Co-, Fe-, Cu- and Ru-ammine complexes may be used as bleach catalysts.

Bleach enhancing transition metal complexes, in particular with the central atoms Mn, Fe, Co, Cu, Mo, V, Ti and/or Ru, preferably selected from the group of manganese and/or cobalt salts and/or complexes, especially preferably the cobalt (ammine) complexes, cobalt (acetate) complexes, cobalt (carbonyl) complexes, the chlorides of cobalt or manganese, manganese sulfate are used.

The chlorine bleaching agents have proven to be especially effective for use in an inventive process. The group of these bleaching agents includes, for example, heterocyclic N-bromoamide and N-chloroamides, such as trichloroisocyanuric acid, tribromoisocyanuric acid, dibromoisocyanuric acid and/or dichloroisocyanuric acid (DICA) and/or their salts with cations such as potassium and sodium. Hydantoin compounds such as 1,3-dichloro-5,5-dimethylhydantoin also belong to the group of these bleaching agents.

Inventive processes in which the cleaning agent B contains 0.1 wt % to 20 wt % of a chlorine bleaching agent are preferred. A preferred subject matter of the present patent application is therefore also a method for machine cleaning of dishes in a dishwashing machine, comprising a prerinse cycle and a cleaning cycle, wherein two liquid cleaning agents A and B of the composition:

A:

10 to 75 wt % builder(s), 0.1 to 10 wt % enzyme(s), 24.9 to 89.9 wt % solvent(s), and

B:

10 to 74.9 wt % builder(s), 25 to 89.9 wt % solvent(s), 0.1 to 15 wt % chlorine bleaching agent(s), are metered into the interior of the dishwashing machine at two successive times t1 and t2, such that the liquid cleaning agent A has a pH (20° C.) between 6 and 9 and is metered at time t1, while the liquid cleaning agent B has a pH (20° C.) between 9 and 14 and is metered at time t2.

The inventive agents described above may also contain other active detergent and active cleaning substances in addition to the ingredients described above, preferably active detergents and cleaning substances from the group of surfactants, polymers, bleach activators, glass corrosion inhibitors, corrosion inhibitors, disintegrants, fragrances and perfume vehicles, coloring agents and preservatives. These preferred ingredients are described in greater detail below.

The group of surfactants includes the nonionic, anionic, cationic and amphoteric surfactants.

Nonionic surfactants that may be used include all the nonionic surfactants with which those skilled in the art are familiar. Suitable nonionic surfactants include, for example, alkyl glycosides of the general formula $RO(G)_x$ in which R corresponds to a primary, linear or methyl-branched, in particular methyl-branched in position 2, aliphatic radical with eight to 22 carbon atoms, preferably twelve to eighteen carbon atoms and G is the symbol standing for a glycose unit with five or six carbon atoms, preferably for glucose. The degree of oligomerization x, which indicates the distribution of monoglycosides and oligoglycosides, may be any number between 1 and 10; x is preferably 1.2 to 1.4.

Another class of nonionic surfactants preferred for use here that are used either as the sole nonionic surfactant or in combination with other nonionic surfactants include alkoxylated, preferably ethoxylated or ethoxylated and propoxylated fatty acid alkyl esters, preferably with one to four carbon atoms in the alkyl chain.

Nonionic surfactants of the amine oxide type, e.g., N-cocoalkyl-N,N-dimethylamine oxide and N-tallow alkyl-N,N-dihydroxyethylamine oxide and the fatty acid alkanolamides may also be suitable. The amount of the nonionic surfactants is preferably no more than that of the ethoxylated fatty alcohols, in particular no more than half thereof.

Other suitable surfactants include polyhydroxy fatty acid amides of the formula

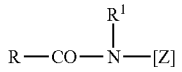

where R stands for an aliphatic acyl radical with six to 22 carbon atoms, $R^1$ stands for hydrogen, an alkyl or hydroxyalkyl radical with one to four carbon atoms and [Z] stands for a linear or branched polyhydroxyalkyl radical with three to ten carbon atoms and three to ten hydroxyl groups. The polyhydroxy fatty acid amides are known substances, which can usually be obtained by reductive amination of a reducing sugar with ammonia, an alkylamine or an alkanolamine and subsequent acylation with a fatty acid, a fatty acid alkyl ester or a fatty acid chloride.

The group of polyhydroxy fatty acid amides also includes compounds of the formula

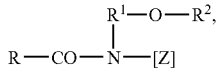

in which R stands for a linear or branched alkyl or alkenyl radical with seven to twelve carbon atoms, $R^1$ stands for a linear, branched or cyclic alkyl radical or an aryl radical with two to eight carbon atoms, and $R^2$ stands for a linear, branched or cyclic alkyl radical or an aryl radical or an oxyalkyl radical with one to eight carbon atoms, where $C_{1-4}$ alkyl or phenyl radicals are preferred, and [Z] stands for a linear polyhydroxyalkyl radical whose alkyl chain is substituted with at least two hydroxyl groups or alkoxylated derivatives, preferably ethoxylated or propoxylated derivatives of this radical.

[Z] is preferably obtained by reductive amination of a reduced sugar, e.g., glucose, fructose, maltose, lactose, galactose, mannose or xylose. The N-alkoxy or N-aryloxy-substituted compounds may be converted to the desired polyhydroxy fatty acid amides by reaction with fatty acid methyl esters in the presence of an alkoxide as the catalyst.

Preferred surfactants include low-sudsing nonionic surfactants. Detergents or cleaning agents, in particular cleaning agents for machine dishwashing, especially preferably contain nonionic surfactants from the group of alkoxylated alcohols. Preferably alkoxylated, advantageously ethoxylated, in particular primary alcohols with preferably eight to eighteen carbon atoms and an average of 1 to 12 mol ethylene oxide (EO) per mol alcohol are used as the nonionic surfactants in which the alcohol radical may be linear or preferably with a methyl branching in position 2 and/or may have linear and methyl-branched radicals in mixture, such as those usually found in oxo alcohol radicals. However, alcohol ethoxylates with linear radicals from alcohols of native origin with twelve to eighteen carbon atoms, e.g., from coconut, palm, tallow or oleyl alcohol and an average of 2 to 8 mol EO per mol alcohol are especially preferred. The preferred ethoxylated alcohols include, for example, $C_{12-14}$ alcohols with 3 EO or 4 EO, $C_{9-11}$ alcohols with 7 EO, $C_{13-15}$ alcohols with 3 EO, 5 EO, 7 EO or 8 EO, $C_{12-18}$ alcohols with 3 EO, 5 EO or 7 EO and mixtures thereof such as mixtures of $C_{12-14}$ alcohol with 3 EO and $C_{12-18}$ alcohol with 5 EO. The stated degrees of ethoxylation are static averages which may correspond to an integer or a fraction for a specific product. Preferred alcohol ethoxylates have a narrow homolog distribution (narrow range ethoxylates, NRE). In addition to these nonionic surfactants, fatty alcohols with more than 12 EO may also be used. Examples include tallow fatty alcohol with 14 EO, 25 EO, 30 EO or 40 EO.

Therefore, ethoxylated nonionics such as those obtained from $C_{6-20}$ monohydroxyalkanols or $C_{6-20}$ alkylphenols or $C_{16-20}$ fatty alcohols and more than 12 mol, preferably more than 15 mol and in particular more than 20 mol ethylene oxide per mol alcohol are especially preferably used. An especially preferred nonionic surfactant is obtained from a linear fatty alcohol with 16 to 20 carbon atoms ($C_{16-20}$ alcohol), preferably a $C_{18}$ alcohol and at least 12 mol, preferably at least 15 mol and in particular at least 20 mol ethylene oxide is especially preferred. Of these, the so-called "narrow range ethoxylates" are especially preferred.

In addition, surfactants containing one or more tallow fatty alcohols with 20 to 30 EO in combination with a silicone foam suppressant are especially preferred.

Especially preferred are nonionic surfactants having a melting point above room temperature. Nonionic surfactant(s) having a melting point above 20° C., preferably above 25° C., especially preferably between 25° C. and 60° C. and in particular between 26.6° C. and 43.3° C. is/are especially preferred.

Suitable nonionic surfactants having melting and/or softening points in the aforementioned temperature range are, for example, low-sudsing nonionic surfactants which may be solid or highly viscous at room temperature. If nonionic surfactants which are highly viscous at room temperature are used, it is preferable if they have a viscosity above 20 Pa·s, preferably above 35 Pa·s and in particular above 40 Pa·s. Nonionics having a waxy consistency at room temperature are also preferred.

Nonionics from the group of alkoxylated alcohols, especially preferably from the group of mixed alkoxylated alcohols and in particular from the group of EO-AO-EO nonionics are also especially preferably used.

The nonionic surfactant, which is solid at room temperature, preferably contains propylene oxide units in the molecule. Such PO units preferably constitute up to 25 wt %, especially preferably up to 20 wt % and in particular up to 15 wt % of the total molecular weight of the nonionic surfactant. Especially preferred nonionic surfactants are the ethoxylated monohydroxy alkanols or alkylphenols which additionally contain polyoxyethylene-polyoxypropylene block copolymer units. The alcohol part and/or the alkylphenol part of such nonionic surfactant molecules constitutes preferably more than 30 wt %, especially preferably more than 50 wt % and in particular more than 70 wt % of the total molecular weight of such nonionics. Preferred agents are characterized in that they contain ethoxylated and propoxylated nonionics in which the propylene oxide units in the molecule constitute up to 25 wt %, preferably up to 20 wt % and in particular up to 15 wt % of the total molecular weight of the nonionic surfactant.

Surfactants that are preferred for use come from the groups of alkoxylated nonionics, in particular the ethoxylated primary alcohols and mixtures of these surfactants having a more complex structure, e.g., polyoxypropylene/polyoxyethylene/polyoxypropylene ((PO/EO/PO) surfactants). Such PO/EO/PO nonionics are also characterized by good foaming control.

Other especially preferred nonionics with melting points above room temperature contain 40% to 70% of a polyoxypropylene/polyoxyethylene/polyoxypropylene block polymer blend containing 75 wt % of an inverted block copolymer of polyoxyethylene and polyoxypropylene with 17 mol ethylene oxide and 44 mol propylene oxide and 25 wt % of a block copolymer of polyoxyethylene and polyoxypropylene initiated with trimethylolpropane and containing 24 mol % ethylene oxide and 99 mol propylene oxide per mol trimethylolpropane.

Within the scope of the present invention, low-sudsing nonionics that contain alternating ethylene oxide units and alkylene oxide units as used here have proven to be especially preferred nonionics. Of these, surfactants with EO-AO-EO-AO blocks are in turn preferred, with one to ten EO and/or AO groups being bound to one another before a block from the other group, respectively, follows. Nonionic surfactants of the following general formula are preferred:

$$R^1-O-(CH_2-CH_2-O)_w-(CH_2-\underset{\underset{R^2}{|}}{CH}-O)_x-(CH_2-CH_2-O)_y-(CH_2-\underset{\underset{R^3}{|}}{CH}-O)_z-H$$

in which $R^1$ denotes a linear or branched, saturated or mono- or polyunsaturated $C_{6-24}$ alkyl radical or alkenyl radical. Each group $R^2$ and/or $R^3$ independently of one another is selected from $-CH_3$, $-CH_2CH_3$, $-CH_2CH_2-CH_3$, $CH(CH_3)_2$ and the indices w, x, y, z independently of one another stand for integers from 1 to 6.

The preferred nonionics of the formula given above can be synthesized by known methods from the corresponding alcohols $R^1$—OH and ethylene oxide and/or alkylene oxide. The radical $R^1$ in the formula given above may be varied, depending on the source of the alcohol. If native sources are used, the $R^1$ radical has an even number of carbon atoms and is usually unbranched, such that the linear radicals of alcohols of native origin with 12 to 18 carbon atoms, e.g., coconut, palm, tallow or oleyl alcohol are preferred. Alcohols accessible from synthetic sources include, for example, the Guerbet alcohols or linear and methyl-branched radicals and/or those with methyl branching in position 2 in mixture, such as those conventionally present in oxo alcohol radicals. Regardless of how the alcohols used in the nonionics contained in the agents are produced, nonionics in which $R^1$ in the formula given above stands for an alkyl radical with 6 to 24 carbon atoms, preferably 8 to 20 carbon atoms, especially preferably 9 to 15 carbon atoms and in particular 9 to 11 carbon atoms are preferred.

In addition to propylene oxide, in particular butylene oxide may be considered as the alkylene oxide unit which is present in the preferred nonionics in alternation with the ethylene oxide unit. However, other alkylene oxides in which $R^2$ and/or $R^3$ independently of one another are selected —$CH_2CH_2$—$CH_3$ and/or $CH(CH_3)_2$ are also suitable. Nonionics of the formula given above in which $R^2$ and/or $R^3$ stand for a —$CH_3$ radical, w and x independently of one another stand for values of 3 or 4, and y and z independently of one another stand for values of 1 or 2 are preferred.

In summary, in particular nonionic surfactants having a $C_{9-15}$ alkyl radical with one to three ethylene oxide units, followed by one to four propylene oxide units, followed by one to four ethylene oxide units, followed by one to four propylene oxide units are preferred in particular. These surfactants have the required low viscosity in aqueous solution and may be used with particular preference according to the invention.

Preferred surfactants are those of the general formula $$R^1\text{—}CH(OH)CH_2O\text{-}(AO)_w\text{-}(A'O)_x\text{-}(A''O)_y\text{-}(A'''O)_z\text{—}R^2,$$

in which $R^1$ and $R^2$ independently of one another stand for a linear or branched, saturated or mono- and/or polyunsaturated $C_{2-40}$ alkyl radical or alkenyl radical; A, A', A" and A'" independently of one another stand for a radical from the group —$CH_2CH_2$, —$CH_2CH_2$—$CH_2$, —$CH_2$—$CH(CH_3)$, —$CH_2$—$CH_2$—$CH_2$—$CH_2$, —$CH_2$—$CH(CH_3)$—$CH_2$—, —$CH_2$—$CH(CH_2$—$CH_3)$; and w, x, y and z stand for values between 0.5 and 90, where x, y and/or z may also be 0.

In particular, the preferred end group-capped polyoxyalkylated nonionics are those according to the formula $$R^1O[CH_2CH_2O]_xCH_2CH(OH)R^2$$

which also contain, in addition to an $R^1$ radical, which stands for linear or branched, saturated or unsaturated, aliphatic or aromatic hydrocarbon radicals with 2 to 30 carbon atoms, preferably with 4 to 22 carbon atoms, a linear or branched, saturated or unsaturated, aliphatic or aromatic hydrocarbon radical $R^2$ with 1 to 30 carbon atoms, where x stands for values between 1 and 90, preferably for values between 40 and 80 and in particular for values between 40 and 60.

Especially preferred are surfactants of the formula $$R^1O[CH_2CH(CH_3)O]_x[CH_2CH_2O]_yCH_2CH(OH)R^2,$$

in which $R^1$ stands for a linear or branched aliphatic hydrocarbon radical with 4 to 18 carbon atoms or mixtures thereof, $R^2$ stands for a linear or branched hydrocarbon radical with 2 to 26 carbon atoms or mixtures thereof and x stands for values between 0.5 and 1.5 and y stands for a value of at least 15.

Also especially preferred are such end group-capped polyoxyalkylated nonionics of the formula $$R^1O[CH_2CH(CH_3)O]_x[CH_2CH_2O]_yCH_2CH(OH)R^2,$$

in which $R^1$ and $R^2$ independently of one another stand for a linear or branched, saturated or mono- and/or polyunsaturated hydrocarbon radical with 2 to 26 carbon atoms, $R^3$ independently of the others is selected from —$CH_3$, —$CH_2CH_3$, —$CH_2$—$CH_2$—$CH_3$, $CH(CH_3)_2$, but preferably stands for —$CH_3$, and x and y independently of one another stand for values between 1 and 32, whereby nonionics in which $R^3$=—$CH_3$ and x has values of 15 to 32 and y has values of 0.5 and 1.5 are most especially preferred.

Other preferred nonionics for use here are the end group-capped polyoxyalkylated nonionics of the formula $$R^1O[CH_2CH(R^3)O]_x[CH_2]_kCH(OH)[CH_2]_jOR^2,$$

in which $R^1$ and $R^2$ stand for linear or branched, saturated or unsaturated aliphatic or aromatic hydrocarbon radicals with 1 to 30 carbon atoms, $R^3$ stands for H or a methyl, ethyl, n-propyl, isopropyl, n-butyl, 2-butyl or 2-methyl-2-butyl radical, x stands for values between 1 and 30, k and j stand for values between 1 and 12, preferably between 1 and 5. If the value $x \geqq 2$, then any $R^3$ in the above formula $R^1O[CH_2CH(R^3)O]_x[CH_2]_kCH(OH)[CH_2]_jOR^2$ may be different. $R^1$ and $R^2$ are preferably linear or branched, saturated or unsaturated aliphatic or aromatic hydrocarbon radicals with 6 to 22 carbon atoms, where radicals with 8 to 18 carbon atoms are especially preferred. H, —$CH_3$ or —$CH_2CH_3$ are especially preferred for the $R^3$ radical. Especially preferred values for x are in the range of 1 to 20, in particular 6 to 15.

As described above, each $R^3$ in the formula given above may be different if $x \geqq 2$. In this way, the alkylene oxide unit in brackets may be varied. For example, if x stands for 3, then the $R^3$ radical may be selected to form ethylene oxide ($R^3$=H) or propylene oxide ($R^3$=$CH_3$) units, which may be joined together in any order, e.g. (EO)(PO)(EO), (EO)(EO)(PO), (EO)(EO)(EO), (PO)(EO)(PO), (PO)(PO)(EO) and (PO)(PO)(PO). The value 3 for x has been selected here as an example and may easily be larger, in which case the range of variation increases with an increase in x value and includes, for example, a large number of PO groups combined with a small number of PO groups or vice-versa.

Especially preferred end group-capped polyoxyalkylated alcohols of the formula given above have values of k=1 and j=1, so the formula above is simplified to $R^1O[CH_2CH(R^3)O]_xCH_2CH(OH)CH_2OR^2$. In the last formula, $R^1$, $R^2$ and $R^3$ are defined as above and x stands for numbers from 1 to 30, preferably from 1 to 20 and in particular from 6 to 18. Especially preferred are surfactants in which the radicals $R^1$ and $R^9$ each have 9 to 14 carbon atoms, $R^3$ stands for H and x assumes values from 6 to 15.

The stated carbon chain lengths as well as degrees of ethoxylation and/or degrees of alkoxylation of the aforementioned nonionics are statistical averages, which may be an integer or a fraction for a specific product. Based on the production process, commercial products of the aforementioned formulas usually do not consist of one individual representative but instead are mixtures, so that averages and therefore fractions may be obtained for the carbon chain lengths as well as for the degrees of ethoxylation and/or the degrees of alkoxylation.

The aforementioned nonionic surfactants may be used not only as individual substances but also as surfactant mixtures of two, three, four or more surfactants. Surfactant mixtures are not mixtures of nonionic surfactants that fall in their totality under one of the general formulas given above but instead are such mixtures containing two, three, four or more nonionic surfactants, which can be described by various ones of the aforementioned general formulas.

Inventive processes that are characterized in that the cleaning agent A also contains 0.2 wt % to 10 wt %, preferably 0.4 wt % to 7 wt % and in particular 0.6 wt % to 4 wt % nonionic surfactant are preferred.

Instead of or in combination with the aforementioned surfactants, cationic and/or amphoteric surfactants may also be used.

For example, cationic compounds of the following formulas may be used as cationic active substances.

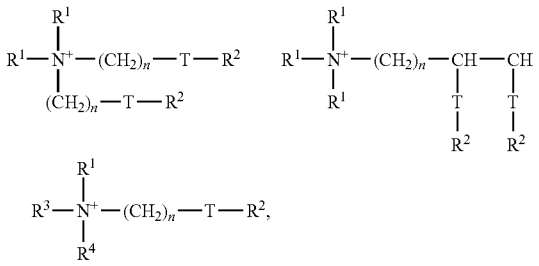

in which each $R^1$ group independently of one another is selected from $C_{1-6}$ alkyl, alkenyl or hydroxyalkyl groups; each $R^2$ group independently of one another is selected from $C_{8-28}$ alkyl or alkenyl groups; $R^3$=$R^1$ or $(CH_2)_n$-T-$R^2$; $R^4$=$R^1$ or $R^2$ or $(CH_2)_n$-T-$R^2$; T=—$CH_2$—, —O—CO or —CO—O— and n is an integer from 0 to 5.

The group of polymers includes in particular the active detergent or active cleaning polymers, e.g., the clear rinse polymers and/or polymers that act as water softeners. In general, in addition to nonionic polymers, cationic, anionic and amphoteric polymers may also be used in detergents and cleaning agents.

"Cationic polymers" in the sense of the present invention are polymers which have a positive charge in the polymer molecule. These may be implemented, for example, by (alkyl)ammonium groups present in the polymer chain or other positively charged groups. Especially preferred cationic polymers come from the groups of quaternary cellulose derivatives, polysiloxanes with quaternary groups, cationic guar derivatives, polymeric dimethyldiallyl-ammonium salts and their copolymers with esters and amides of acrylic acid and methacrylic acid, the copolymers of vinylpyrrolidone with quaternated derivatives of dialkyl aminoacrylate and methacrylate, vinylpyrrolidone methoimidazolinium chloride copolymers, quaternated polyvinyl alcohols or the polymers known by the INCI designations polyquaternium 2, polyquaternium 17, polyquaternium 18 and polyquaternium 27.

"Amphoteric polymers" in the sense of the present invention also have, in addition to a positively charged group in the polymer chain, negatively charged groups and/or monomer units. These groups may be, for example, carboxylic acids, sulfonic acids or phosphonic acids.

Preferred detergents or cleaning agents in particular preferred machine dishwashing agents are characterized in that they contain a polymer a) which has monomer units of the formula $R^1R^2C$=$CR^3R^4$ in which each radical $R^1$, $R^2$, $R^3$, $R^4$ independently of one another is selected from hydrogen, derivatized hydroxyl groups, $C_{1-30}$ linear or branched alkyl groups, aryl, aryl-substituted $C_{1-30}$ linear or branched alkyl groups, polyalkoxylated alkyl groups, heteroatomic organic groups with at least one positive charge without charged nitrogen, at least one quaternated nitrogen atom or at least one amino group with a positive charge in the partial part of the pH range from 2 to 11 or salts thereof, with the provision that at least one radical $R^1$, $R^2$, $R^3$, $R^4$ is a heteroatomic organic group with at least one positive charge, not including nitrogen, at least one quaternated nitrogen atom or at least one amino group with a positive charge.

Within the scope of the present patent application, cationic or amphoteric polymers that are specially preferred contain as the monomer unit a compound of the general formula

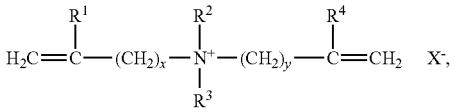

in which $R^1$ and $R^4$ independently of one another stand for H or a linear or branched carbohydrate radical with 1 to 6 carbon atoms; $R^2$ and $R^3$ independently of one another stand for an alkyl group, a hydroxyalkyl group or an aminoalkyl group in which the alkyl radical is linear or branched and has between 1 and 6 carbon atoms, such that it is preferably a methyl group; x and y independently of one another stand for integers between 1 and 3. $X^-$ represents a counterion, preferably a counterion from the group of chloride, bromide, iodide, sulfate, bisulfate, methosulfate, lauryl sulfate, dodecyl-benzenesulfate, p-toluenesulfate (tosylate), cumene-sulfonate, xylene-sulfonate, phosphate, citrate, formate, acetate or mixtures thereof.

Preferred radicals $R^1$ and $R^4$ in the formula given above are selected from —$CH_3$, —$CH_2$—$CH_3$, —$CH_2$—$CH_2$—$CH_3$, —CH($CH_3$)—$CH_3$, —$CH_2$—OH, —$CH_2$—$CH_2$—OH, —CH(OH)—$CH_3$, —$CH_2$—$CH_2$—$CH_2$—OH, —$CH_2$—CH(OH)—$CH_3$, —CH(OH)—$CH_2$—$CH_3$, —($CH_2CH_2$—O)$_n$H.

Most especially preferred are polymers containing a cationic monomer unit of the aforementioned general formula, in which $R^1$ and $R^4$ stand for H, $R^2$ and $R^3$ stand for methyl, and x and y are each 1. The corresponding monomer units of the formula

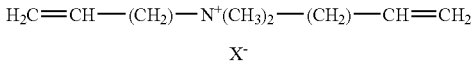

are also known as DADMAC (diallyldimethylammonium chloride) in the case when $X^-$=chloride.

Other especially preferred cationic or amphoteric polymers contain a monomer unit of the general formula

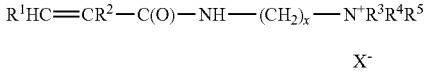

in which $R^1$, $R^2$, $R^3$, $R^4$ and $R^5$ independently of one another stand for a linear or branched, saturated or unsaturated alkyl or hydroxyalkyl radical with 1 to 6 carbon atoms, preferably a linear or branched alkyl radical selected from —$CH_3$, —$CH_2$—$CH_3$, —$CH_2$—$CH_2$—$CH_3$, —CH($CH_3$)—$CH_3$, —$CH_2$—OH, —$CH_2$—$CH_2$—OH, —CH(OH)—$CH_3$, —$CH_2$—$CH_2$—$CH_2$—OH, —$CH_2$—CH(OH)—$CH_3$, —CH(OH)—$CH_2$—$CH_3$ and —($CH_2CH_2$—O)$_n$H, and x stands for an integer between 1 and 6.

Most especially preferred within the scope of the present invention are polymers having a cationic monomer unit of the general formula given above, in which $R^1$ stands for H and $R^2$, $R^3$, $R^4$ and $R^5$ stand for methyl and x stands for 3. The corresponding monomer units of the formula $$H_2C{=}C(CH_3){-}C(O){-}NH{-}(CH_2)_x{-}N^+(CH_3)_3\ X^-$$

are also known as MAPTAC (methacrylamidopropyltrimethylammonium chloride) in the case when $X^-$=chloride.

Polymers containing as monomer units diallyldimethylammonium salt and/or acrylamidopropyltrimethylammonium salts are preferred for use according to this invention.

The aforementioned amphoteric polymers have not only cationic groups but also anionic groups and/or monomer units. Such anionic monomer units originate from, for example, the group of linear or branched, saturated or unsaturated carboxylates, linear or branched, saturated or unsaturated phosphonates, linear or branched, saturated or unsaturated sulfates or linear or branched, saturated or unsaturated sulfonates. Preferred monomer units are acrylic acid, (meth) acrylic acid, (dimeth)acrylic acid, (ethyl)acrylic acid, cyanoacrylic acid, vinylacetic acid, allylacetic acid, crotonic acid, maleic acid, fumaric acid, cinnamic acid and their derivatives, allylsulfonic acids, e.g., allyloxybenzenesulfonic acid and methallylsulfonic acid or allylphosphonic acids.

Amphoteric polymers preferred for use come from the group of alkylacrylamide/acrylic acid copolymers, alkylacrylamide/methacrylic acid copolymers, alkylacrylamide/methyl methacrylic acid copolymers, alkylacrylamide/acrylic acid/alkylaminoalkyl(meth)acrylic acid copolymers, alkylacrylamide/methacrylic acid/alkylaminoalkyl(meth)acrylic acid copolymers, alkylacrylamide/methyl methacrylic acid/alkylaminoalkyl(meth)acrylic acid copolymers, alkylacrylamide/alkylmethacrylate/alkylaminoethyl methacrylate/alkylmethacrylate copolymers as well as the copolymer of unsaturated carboxylic acids, cationically derivatized unsaturated carboxylic acid and optionally other ionic or nonionic monomers.

Zwitterionic polymers preferred for use here come from the group of acrylamidoalkyltrialkylammonium chloride/acrylic acid copolymers and their alkali salts and ammonium salts, acrylamidoalkyltrialkylammonium chloride/methacrylic acid copolymers and their alkaline and ammonium salts and methacroylethylbetaine/methacrylate copolymers.

Also preferred for use are the amphoteric polymers comprising methacrylamido-alkyltrialkylammonium chloride and dimethyldiallylammonium chloride as cationic monomers in addition to one or more anionic monomers.

Especially preferred amphoteric polymers come from the group of methacrylamidoalkyltrialkylammonium chloride/dimethyl(diallyl)ammonium chloride/acrylic acid copolymers, methacrylamidoalkyltrialkylammonium chloride/dimethyl(diallyl)ammonium chloride/methacrylic acid copolymers and methacrylamidoalkyltrialkylammonium chloride/dimethyl(diallyl)ammonium chloride/alkyl(meth) acrylic acid copolymers as well as their alkali and ammonium salts. Preferred in particular are amphoteric polymers from the group of methacrylamidopropyltrimethylammonium chloride/dimethyl-(diallyl)ammonium chloride/acrylic acid copolymers, methacrylamidopropyl-trimethylammonium chloride/dimethyl(diallyl)ammonium chloride/acrylic acid copolymers and methacrylamidopropyltrimethylammonium chloride/dimethyl(diallyl)ammonium chloride/alkyl(meth) acrylic acid copolymers as well as their alkali and ammonium salts.

In an especially preferred embodiment of the present invention, the polymers are present in prefabricated form. For fabrication of the polymers, the following are suitable, among others:

- Coating agents, preferably by means of water-soluble or water-dispersible natural or synthetic polymers;
- Encapsulation of the polymer by means of water-insoluble, fusible coating agents, preferably by means of water-insoluble coating agents from the group of waxes or paraffins with a melting point above 30° C.;
- Cogranulation of the polymers with inert carrier materials, preferably with carrier materials from the group of active detergents and cleaning substances, especially preferably from the group of builders or cobuilders.

Preferred cleaning agents contain the aforementioned cationic and/or amphoteric polymers, preferably in amounts between 0.01 wt % and 8 wt %, each based on the total weight of the combination product. Within the scope of the present patent application, however, combination products in which the amount by weight of the cationic and/or amphoteric polymers is between 0.01 wt % and 6 wt %, preferably between 0.01 wt % and 4 wt %, especially preferably between 0.01 wt % and 2 wt % and in particular between 0.01 wt % and 1 wt %, each based on the total weight of the cleaning agent, are preferred.

Polymers that act as water softeners include, for example, the polymers containing sulfonic acid groups, which are used to particular advantage.

Copolymers of unsaturated carboxylic acids, monomers containing sulfonic acid groups and optionally other ionic or nonionic monomers may especially preferably be used as polymers containing sulfonic acid groups.

Preferred monomers within the scope of the present invention are unsaturated carboxylic acids of the formula $$R^1(R^2)C{=}C(R^3)COOH$$

in which $R^1$ to $R^3$ independently of one another stand for —H, —$CH_3$, a linear or branched, saturated alkyl radical with two to twelve carbon atoms, a linear or branched mono- or polyunsaturated alkenyl radical with two to twelve carbon atoms, alkyl or alkenyl radicals substituted with —$NH_2$, —OH or —COOH or for —COOH or —$COOR^4$, in which $R^4$ is a saturated or unsaturated, linear or branched hydrocarbon radical with 1 to 12 carbon atoms.

Of the unsaturated carboxylic acids which can be described by the formula given above, in particular acrylic acid ($R^1$=$R^2$=$R^3$=H), methacrylic acid ($R^1$=$R^2$=H; $R^3$=$CH_3$) and/or maleic acid ($R^1$=COOH; $R^2$=$R^3$=H) are preferred.

Of the monomers containing sulfonic acid groups, those that are preferred have the formula $$R^5(R^6)C{=}C(R^7){-}X{-}SO_3H$$

in which $R^5$ to $R^7$ independently of one another stand for H, $CH_3$, a linear or branched, saturated alkyl radical with 2 to 12 carbon atoms, a linear or branched mono- or polyunsaturated alkenyl radical with 2 to 12 carbon atoms, alkyl or alkenyl radicals substituted with —$NH_2$, —OH or —COOH or stands for —COOH or —$COOR^4$, where $R^4$ is a saturated or unsaturated, linear or branched hydrocarbon radical with 1 to 12 carbon atoms and X stands for an optional spacer group, which is selected from —$(CH_2)_n$, where n=0 to 4, —COO—$(CH_2)_k$—, where k=1 to 6, —C(O)—NH—C9$CH_3)_2$ and —C(O)—NH—CH($CH_2CH_3$)—.

Of these monomers, those that are preferred have the formulas $H_2C{=}CH{-}X{-}SO_3H$ $H_2C{=}C(CH_3){-}X{-}SO_3H$ $HO_3S{-}X{-}(R^6)C{=}C(R^7){-}X{-}SO_3H$, in which $R^6$ and $R^7$ independently of one another are selected from —H, —$CH_3$, —$CH_2CH_3$, —$CH_2CH_2CH_3$, —CH$(CH_3)_2$ and X stands for an optional spacer group selected from —$(CH_2)_n$—, where n=0 to 4, —COO—$(CH_2)_k$—, where k=1 to 6, —C(O)—NH—C$(CH_3)_2$— and —C(O)—NH—CH($CH_2CH_3$)—

Especially preferred monomers containing sulfonic acid groups include 1-acrylamido-1-propanesulfonic acid, 2-acrylamido-2-propanesulfonic acid, 2-arylamido-2-methyl-1-propanesulfonic acid, 2-methacrylamido-2-methyl-1-propanesulfonic acid, 3-methacrylamido-2-hydroxypropanesulfonic acid, allylsulfonic acid, methallylsulfonic acid, allyloxybenzenesulfonic acid, meth-allyoxybenzenesulfonic acid, 2-hydroxy-3-(2-propenyloxy)propanesulfonic acid, 2-methyl-2-propene-1-sulfonic acid, styrene sulfonic acid, vinyl sulfonic acid, 3-sulfopropyl acrylate, 3-sulfopropyl methacrylate, sulfomethacrylamide, sulfomethylmethacrylamide and water-soluble salts of the aforementioned acids.

In particular ethylenically unsaturated compounds may be considered as additional ionic or nonionic monomers. The amount of these additional ionic or nonionic monomers in the starting polymers is preferably less than 20 wt %, based on the polymer. Polymers especially preferred for use consist only of monomers of the formula $R^1(R^2)C{=}C(R^3)COOH$ and monomers of the formula $R^5(R^6)C{=}C(R^7){-}X{-}SO_3H$.

In summary, copolymer of i) unsaturated carboxylic acids of the formula $R^1(R^2)C{=}C(R^3)COOH$, in which $R^1$ to $R^3$ independently of one another stand for —H, —$CH_3$, a linear or branched, saturated radical with two to twelve carbon atoms, a linear or branched mono- or polyunsaturated alkenyl radical with two to twelve carbon atoms, alkyl or alkenyl radicals as defined above with —$NH_2$, —OH or —COOH substituents or stands for —COOH or —$COOR^4$, where $R^4$ stands for a saturated or unsaturated, linear or branched hydrocarbon radical with 1 to 12 carbon atoms, ii) monomers containing sulfonic acid groups according to the formula $R^5(R^6)C{=}C(R^7){-}X{-}SO_3H$, in which $R^5$ to $R^7$ independently of one another stand for —H, —$CH_3$, a linear or branched, saturated alkyl radical with two to twelve carbon atoms, a linear or branched mono- or polyunsaturated alkenyl radical with two to twelve carbon atoms, alkyl or alkenyl radicals substituted with —$NH_2$, —OH or —COOH as defined above or stands for —COOH or —$COOR^4$, where $R^4$ is a saturated or unsaturated, linear or branched hydrocarbon radical with 1 to 12 carbon atoms, and X stands for an optional spacer group selected from —$(CH_2)_n$— where n=0 to 4, —COO—$(CH_2)_k$— where k=1 to 6, —C(O)—NH—C$(CH_3)_2$— and —C(O)—NH—CH($CH_2CH_3$)

iii) optionally other ionic or nonionic monomers are especially preferred.

Other especially preferred copolymers consist of i) one or more unsaturated carboxylic acids from the group of acrylic acid, methacrylic acid and/or maleic acid, ii) one or more monomers containing sulfonic acid groups according to the formulas $H_2C{=}CH{-}X{-}SO_3H$ $H_2C{=}C(CH_3){-}X{-}SO_3H$ $HO_3S{-}X{-}(R^6)C{=}C(R^7){-}X{-}SO_3H$ in which $R^6$ and $R^7$ independently of one another are selected from —H, —$CH_3$, —$CH_2CH_3$, —$CH_2CH_2CH_3$, —CH$(CH_3)_2$ and X stands for an optional spacer group which is selected from —$(CH_2)_n$—, where n=0 to 4, —COO—$(CH_2)_k$—, where k=1 to 6, —C(O)—NH—C$(CH_3)_2$— and —C(O)—NH—CH($CH_2CH_3$)— iii) optionally other ionic or nonionic monomers.

The copolymers may contain the monomers from groups i) and ii) and optionally iii) in varying amounts, such that all the representatives from group i) can be combined with all the representatives from group ii) and all the representative from group iii).

Especially preferred polymers have certain structural units which are described below.

For example, copolymers having structural units of the formula $$-[CH_2{-}CHCOOH]_m{-}[CH_2{-}CHC(O){-}Y{-}SO_3H]_p-$$

in which m and p each stand for a natural integer between 1 and 2000 and Y stands for a spacer group selected from substituted, aliphatic, aromatic hydrocarbon radicals or substituted aromatic hydrocarbon radicals with 1 to 24 carbon atoms, such that spacer groups in which Y stands for —O—$(CH_2)_n$—, where n=0 to 4, for —O—$(C_6H_4)$—, for —NH—C$(CH_3)_2$— or —NH—CH($CH_2CH_3$)— are preferred.

These polymers are produced by copolymerization of acrylic acid with an acrylic acid derivative containing sulfonic groups. If the acrylic acid derivative containing sulfonic acid groups is copolymerized with methacrylic acid, then another polymer is obtained whose use is also preferred. The corresponding copolymers contain the structural units of the formula $$-[CH_2{-}CHCOOH]_m{-}[CH_2{-}CHC(O){-}Y{-}SO_3H]_p-$$

in which m and p each stand for a natural integer between 1 and 2000 and Y stands for a spacer group selected from substituted or unsubstituted, aliphatic, aromatic or substituted aromatic hydrocarbon radicals with 1 to 24 carbon atoms, whereby spacer groups in which Y stands for —O—$(CH_2)_n$—, where n=0 to 4, for —O—$(C_6H_4)$—, for —NH—C$(CH_3)_2$— or —NH—CH($CH_2CH_3$)— are preferred.

By complete analogy, acrylic acid and/or methacrylic acid may also be copolymerized with methacrylic acid derivatives containing sulfonic acid groups, so that the structural units in the molecule are altered. For example copolymers containing structural units of the formula $$-[CH_2{-}CHCOOH]_m{-}[CH_2{-}CHC(O){-}Y{-}SO_3H]_p-$$

in which m and p each stand for a natural integer between 1 and 2000 and Y stands for a spacer group selected from substituted or unsubstituted, aliphatic, aromatic or substituted aromatic hydrocarbon radicals with 1 to 24 carbon atoms, whereby spacer groups in which Y stands for —O—$(CH_2)_n$—, where n=0 to 4, for —O—$(C_6H_4)$—, for —NH—C$(CH_3)_2$— or —NH—CH($CH_2CH_3$)— are just as preferred as are copolymers containing structural units of the formula $$-[CH_2{-}CHCOOH]_m{-}[CH_2{-}CHC(O){-}Y{-}SO_3H]_p-$$

in which m and p each stand for a natural integer between 1 and 2000 and Y stands for a spacer group selected from substituted or unsubstituted, aliphatic, aromatic or substituted aromatic hydrocarbon radicals with 1 to 24 carbon atoms, whereby spacer groups in which Y stands for —O—$(CH_2)_n$—, where n=0 to 4, for —O—$(C_6H_4)$—, for —NH—$C(CH_3)_2$— or —NH—$CH(CH_2CH_3)$— are preferred.

Instead of and/or in addition to acrylic acid and/or methacrylic acid, maleic acid may also be used as an especially preferred monomer from group i). In this way, the copolymers that are preferred according to the invention and contain structural units of the formula $$—[HOOCCH—CHCOOH]_m—[CH_2—CHC(O)—Y—SO_3H]_p—$$

where m and p each stand for a natural integer between 1 and 2000 and Y stands for a spacer group selected from substituted or unsubstituted, aliphatic, aromatic or araliphatic hydrocarbon radicals with 1 to 24 carbon atoms, whereby spacer groups in which Y stands for —O—$(CH_2)_n$—, where n=0 to 4, for —O—$(C_6H_4)$—, for —NH—$C(CH_3)_2$— or —NH—$CH(CH_2CH_3)$— are preferred. Also preferred according to this invention are copolymers containing structural units of the formula $$—[HOOCCH—CHCOOH]_m—[CH_2—C(CH_3)C(O)O—Y—SO_3H]_p—$$

in which m and p each stand for a natural integer between 1 and 2000 and Y stands for a spacer group selected from substituted or unsubstituted, aliphatic, aromatic or substituted aromatic hydrocarbon radicals with 1 to 24 carbon atoms, whereby spacer groups in which Y stands for —O—$(CH_2)_n$—, where n=0 to 4, for —O—$(C_6H_4)$—, for —NH—$C(CH_3)_2$— or —NH—$CH(CH_2CH_3)$— are preferred.

In summary, such copolymers which contain the structural units of the following formulas are preferred according to this invention $$—[CH_2—CHCOOH]_m—[CH_2—CHC(O)—Y—SO_3H]_p—$$

$$—[CH_2—C(CH_3)COOH]_m—[CH_2—CHC(O)—Y—SO_3H]_p—$$

$$—[CH_2—CHCOOH]_m—[CH_2—C(CH_3)C(O)—Y—SO_3H]_p—$$

$$—[CH_2—C(CH_3)COOH]_m—[CH_2—(C(CH_3)C(O)—Y—SO_3H]_p—$$

$$—[HOOCCH—CHCOOH]_m—[CH_2—CHC(O)—Y—SO_3H]_p—$$

$$—[HOOCCH—CHCOOH]_m—[CH_2—C(CH_3)C(O)O—Y—SO_3H]_p—$$

in which m and p each stand for a natural integer between 1 and 2000 and Y stands for a spacer group selected from substituted or unsubstituted, aliphatic, aromatic or substituted aromatic hydrocarbon radicals with 1 to 24 carbon atoms, whereby spacer groups in which Y stands for —O—$(CH_2)_n$—, where n=0 to 4, for —O—$(C_6H_4)$—, for —NH—$C(CH_3)_2$— or —NH—$CH(CH_2CH_3)$— are preferred.

The sulfonic acid groups in the polymers may be present entirely or partially in neutralized form, i.e., the acidic hydrogen atom of the sulfonic acid group may be replaced in some or all sulfonic acid groups with metal ions, preferably alkali metal ions and in particular with sodium ions. Use of partially or completely neutralized copolymers containing sulfonic acid groups is preferred according to the invention.

In copolymers containing only monomers from groups i) and ii), the monomer distribution of the copolymers preferred for use according to the invention amount to preferably 5 wt % to 95 wt % i) and/or ii), especially preferably 50 wt % to 90 wt % monomer from group i) and 10 wt % to 50 wt % monomer from group ii), each based on the polymer.

In terpolymers, those containing 20 wt % to 85 wt % monomer from group i), 10 wt % to 60 wt % monomer from group ii) and 5 wt % to 30 wt % monomer from group iii) are especially preferred.

The molecular weight of the sulfocopolymers preferred for use according to the invention may be varied to adapt the properties of the polymers to the desired intended application. Preferred detergents or cleaning agents are characterized in that the copolymers have molecular weights of 2000 $g \cdot mol^{-1}$ to 200,000 $g \cdot mol^{-1}$, preferably 4000 $g \cdot mol^{-1}$ to 25,000 $g \cdot mol^{-1}$ and in particular 5000 $g \cdot mol^{-1}$ to 15,000 $g \cdot mol^{-1}$.

Combination products which are characterized in that the cleaning agent A and/or the cleaning agent B also contains 0.01 wt % to 15 wt %, preferably 0.02 wt % to 12 wt % and in particular 0.1 wt % to 8 wt % of one or more active detergent or active cleaning polymers, based on the total weight of cleaning agent A and/or B, are also preferred according to the invention.

Glass corrosion inhibitors prevent the development of turbidity, haze and scratches, but also prevent the irisizing of the glass surface of machine-washed glasses. Preferred glass corrosion inhibitors come from the group of magnesium salts and/or zinc salts and/or magnesium complexes and/or zinc complexes.

The spectrum of the zinc salts preferred according to the invention, preferably of organic acids, especially preferably organic carboxylic acids, ranges from salts that have little or no solubility in water, i.e., a solubility of less than 100 mg/L preferably less than 10 mg/L, in particular less than 0.01 mg/L, to salts having a solubility in water of more than 100 mg/L, preferably more than 500 mg/L, especially preferably more than 1 g/L and in particular above 5 g/L (all solubilities at 20° C. water temperature). The first group of zinc salts include, for example, zinc citrate, zinc oleate and zinc stearate; the group of soluble zinc salts includes, for example, zinc formate, zinc acetate, zinc lactate and zinc gluconate.

At least one zinc salt of an organic carboxylic acid, especially preferably a zinc salt from the group of zinc stearate, zinc oleate, zinc gluconate, zinc acetate, zinc lactate and/or zinc citrate is especially preferred as a glass corrosion inhibitor. Zinc ricinoleate, zinc abietate and zinc oxalate are also preferred.

In addition, the soluble inorganic zinc salts in particular zinc sulfate, zinc nitrate and zinc chloride are suitable for glass corrosion prevention.

Corrosion inhibitors serve to protect the washed items or the machine, whereby silver protectants are especially important in the field of machine dishwashing. The known substances of the state of the art may be used. In general, silver protectants may be selected especially from the group of triazoles, benzotriazoles, bisbenzotriazoles, aminotriazoles, alkylaminotriazoles and transition metal salts or complexes. Especially preferred for use here are benzotriazole and/or alkylaminotriazole. Preferred according to the invention are 3-amino-5-alkyl-1,2,4-triazoles and/or their physiologically tolerable salts, whereby the substances are especially preferably used in a concentration of 0.001 wt % to 10 wt %, preferably 0.0025 wt % to 2 wt %, especially preferably 0.01 wt % to 0.04 wt %. Preferred acids for forming the salt include hydrochloric acid, sulfuric acid, phosphoric acid, carbonic acid, sulfurous acid, organic carboxylic acids such as acetic acid, glycolic acid, citric acid, succinic acid. Most especially effective are 5-pentyl, 5-heptyl, 5-nonyl, 5-undecyl, 5-isononyl, 5-versatic-10-acid alkyl-3-amino-1,2,4-triazoles and mixtures of these substances.

In addition, agents containing active chlorine which can definitely decrease corrosion of the silver surface are often used in cleaning agent formulations. In chlorine-free cleaning agents, especially organic redox-active compounds containing oxygen and nitrogen, such as divalent and trivalent phenols, e.g. hydroquinone, pyrocatechol, hydroxyhydroquinone, gallic acid, phloroglucine, pyrogallol and/or derivatives of these compounds are used. Inorganic compounds like salts and complexes, e.g. the salts of metals Mn, Ti, Zr, Hf, V, Co and Ce are also frequently used. Preferred here are the transition metal salts selected from the group of manganese salts and/or cobalt salts and/or complexes, especially preferably the cobalt-(ammine) complexes, the cobalt (acetate) complexes, the cobalt-(carbonyl) complexes, the chlorides of cobalt or manganese and manganese sulfate. Likewise, zinc compounds may also be used to prevent corrosion of the machine-washed items.

Instead of or in addition to the silver protectants described above, e.g. the benzotriazoles, redox-active substances may also be used. These substances are preferably inorganic redox-active substances from the group of manganese, titanium, zirconium, hafnium, vanadium, cobalt and cerium salts and/or complexes, wherein the metals are preferably in one of the oxidation states II, III, IV, V or VI.

The metal salts and/or metal complexes that are used should be at least partially soluble in water. The counterions suitable for forming a salt comprise all conventional inorganic anions with one, two or three negative charges, e.g. oxide, sulfate, nitrate, fluoride but also organic anions, e.g., stearate.

Especially preferred metal salts and/or metal complexes are selected from the group of $MnSO_4$, Mn(II) citrate, Mn(II) stearate, Mn(II) acetylacetonate, Mn(II) 1-hydroxyethane-1, 1-diphosphonate, $V_2O_5$, $V_2O_4$, $VO_2$, $TiOSO_4$, $K_2TiF_6$, $K_2ZrF_6$, $CoSO_4$, $Co(NO_3)_2$, $Ce(NO_3)_3$ as well as mixtures thereof, so that the metal salts and/or metal complexes are selected from the group of $MnSO_4$, Mn(II) citrate, Mn(II) stearate, Mn(II) acetylacetonate, Mn(II) 1-hydroxyethane-1, 1-diphosphonate, $V_2O_5$, $V_2O_4$, $VO_2$, $TiOSO_4$, $K_2TiF_6$, $K_2ZrF_6$, $CoSO_4$, $Co(NO_3)_2$, $Ce(NO_3)_3$ are especially preferably used.

The inorganic redox-active substances, in particular metal salts and/or metal complexes are preferably coated, i.e., covered completely with a material that is watertight but readily soluble at the cleaning temperatures to prevent premature decomposition or oxidation during storage. Preferred coating materials which are applied by known methods, e.g. melt coating methods according to Sandwik from the food industry include paraffins, microwaxes, waxes of natural origin such as carnuba wax, candellila wax, beeswax, higher melting alcohols such as hexadecanol, soaps or fatty acids.

The perfume oils and/or fragrances used within the scope of the present invention include individual perfume compounds, e.g. the synthetic products of the type of esters, ethers, aldehydes, ketones, alcohols and hydrocarbons. However, mixtures of different perfumes which together produce an appealing fragrance note are preferred. Such perfume oils may also contain natural perfume mixtures such as those accessible from plant sources, e.g. pine oil, citrus, oil, jasmine oil, patchouli oil, rose or ylang ylang oil.

To be perceptible, a perfume must be volatile, whereby in addition to the nature of the functional groups and the structure of the chemical compound, the molecular weight also plays an important role. For example, most perfumes have molecular weights up to approximately 200 daltons, whereas molecular weights of 300 daltons and more tend to be the exception. On the basis of the varying volatility of perfumes, the scent of a perfume and/or fragrance comprising multiple perfume ingredients changes during evaporation, for which purpose the scent impressions are subdivided according to top notes, middle notes and/or body and end notes and/or dry out. Since the scent perception is based mostly on the scent intensity, the top note of a perfume and/or fragrance does not consist exclusively of volatile compounds, whereas the end note consists mostly of less volatile, i.e., adherent fragrances. In the composition of perfumes, more readily volatile fragrances may be bound to fixatives, so that excessively rapid evaporation is prevented. In the subsequent classification of the fragrances as "more volatile" and/or "adherent" fragrances, nothing is said about the scent impression or whether the corresponding fragrance is perceived as a top note or as a middle note.

The scents can be processed directly, but it may also be advantageous to apply the scents to carriers, which ensure a more gradual release of the fragrance for a long lasting fragrance. Such carrier materials have proven to be, for example, cyclodextrins, such that the cyclodextrin-perfume complexes may additionally also be coated with other additives.

Preferred coloring agents, the choice of which should not pose any problems for those skilled in the art, have a great stability in storage and are insensitive to the other ingredients of the agent and to light as well as having a pronounced substantivity with respect to the substrates to be treated with the agents containing the coloring agent, e.g., substrates such as textiles, glass, ceramics or plastic dishes, so as not to stain them.

In the choice of coloring agent, one must take into account the fact that the coloring agents have a good stability in storage, are insensitive to light and do not have an excessively great affinity for glass, ceramic or plastic dishes. At the same time, also to be taken into account in the choice of suitable coloring agent is the fact that coloring agents have different stabilities with respect to oxidation. In general, it is true that water-insoluble coloring agents are more stable against oxidation than are water-soluble coloring agents. Depending on the solubility and thus also the oxidation sensitivity, the concentration of the coloring agent in the detergents or cleaning agents varies. In the case of readily water-soluble coloring agents, coloring agent concentrations in the range of a few $10^{-2}$ to $10^{-3}$ wt % are typically selected. In the case of pigment coloring agents, which are especially preferred because of their brilliance but are not as water-soluble, the suitable concentration of the coloring agent in the detergents or cleaning agents is typically a few $10^{-3}$ to $10^{-4}$ wt %.

Coloring agents which can be destroyed by oxidation in the washing process and mixtures thereof with suitable blue coloring agents, so-called blue toners are preferred. It has proven advantageous to use coloring agents which are soluble in water or at room temperature are soluble in liquid organic substances. For example, anionic coloring agents, e.g., anionic nitroso dyes, are suitable.

The inventive cleaning agents may also contain preservatives. Suitable according to this invention are, for example, preservatives from the groups of alcohols, aldehydes, antimicrobial acids and/or their salts, carboxylic acid esters, acid amides, phenols, phenol derivatives, diphenyls, diphenylalkanes, urea derivatives, oxygen, nitrogen acetals and formals, benzamidines, isothiazoles and derivatives thereof, such as isothiazolines and isothiazolinones, phthalimide derivatives, pyridine derivatives, antimicrobial surfactant compounds, guanidines, antimicrobial, amphoteric compounds, quinolines, 1,2-dibromo-2,4-dicyanobutane, iodo-2-propynylbutylcarbamate, iodine, iodophores and peroxides. Preferred antimicrobial active ingredients are preferably selected from the group comprising ethanol, n-propanol, isopropanol, 1,3-butanediol, phenoxyethanol, 1,2-propylene glycol, glycerol, undecylenic acid, citric acid, lactic acid, benzoic acid, salicylic acid, thymol, 2-benzyl-4-chlorophenol, 2,2'-methylene-bis-(6-bromo-4-chlorophenol), 2,4,4'-trichloro-2'-hydroxy-diphenyl ether, N-(4-chlorophenyl)-N-(3,4-dichlorophenyl)-urea, N,N'-(1,1-decanediyldi-1-pyridinyl-4-ylidene)-bis-(1-octanamine)dihydro-chloride, N,N'-bis-(4-chlorophenyl)-3,12-diimino-2,4,11,13-tetraazatetradecane diimideamide, antimicrobial quaternary surfactant compounds, guanidines. However, especially preferred preservatives are selected from the group comprising salicylic acid, quaternary surfactants, in particular benzalkonium chloride and isothiazoles and their derivatives such as isothiazolines and isothiazolinones.

With regard to their efficiency and stability in storage, a number of cleaning agents have proven to be especially advantageous:

For this reason, preferred methods of machine cleaning of dishes in a dishwashing machine according to the invention are those in which, during the course of a cleaning program comprising a prerinse cycle and a cleaning cycle, two liquid cleaning agents A and B of the following compositions are metered into the interior of the dishwashing machine at two successive times t1 and t2:

A according to the following table

B according to the following table whereby the liquid cleaning agent A has a pH (20° C.) between 6 and 9 and is metered at time t1, while the liquid cleaning agent B has a pH (20° C.) between 9 and 14 and is metered at time t2.

| Running number | Cleaning A, containing | Cleaning agent B, containing |
|---|---|---|
| 1 | 10 to 75 wt % builder(s)<br>0.1 to 10 wt % enzyme(s)<br>24.9 to 89.9 wt % water | 10 to 74.9 wt % builder(s)<br>25 to 89.9 wt % water<br>0.1 to 15 wt % bleaching agent(s) |
| 2 | 10 to 74.9 wt % builder(s)<br>0.1 to 10 wt % enzyme(s)<br>24.9 to 89.8 wt % water<br>0.01 to 15 wt % polymer containing sulfonic acid groups | 10 to 74.9 wt % builder(s)<br>25 to 89.9 wt % water<br>0.1 to 15 wt % bleaching agent(s) |
| 3 | 10 to 74.8 wt % builder(s)<br>0.1 to 10 wt % enzyme(s)<br>24.9 to 89.7 wt % water<br>0.2 to 10.0 nonionic surfactant | 10 to 74.9 wt % builder(s)<br>25 to 89.9 wt % water<br>0.1 to 15 wt % bleaching agent(s) |
| 4 | 10 to 74.7 wt % builder(s)<br>0.1 to 10 wt % enzyme(s)<br>24.9 to 89.6 wt % water<br>0.2 to 10.0 nonionic surfactant<br>0.01 to 15 wt % polymer containing sulfonic acid groups | 10 to 74.9 wt % builder(s)<br>25 to 89.9 wt % water<br>0.1 to 15 wt % bleaching agent(s) |
| 5 | 10 to 75 wt % builder(s)<br>0.1 to 10 wt % enzyme(s)<br>24.9 to 89.9 wt % water | 10 to 74.8 wt % builder(s)<br>25 to 89.8 wt % water<br>0.1 to 15 wt % bleaching agent(s)<br>0.01 to 15 wt % polymer containing sulfonic acid groups |
| 6 | 10 to 74.9 wt % builder(s)<br>0.1 to 10 wt % enzyme(s)<br>24.9 to 89.8 wt % water<br>0.01 to 15 wt % polymer containing sulfonic acid groups | 10 to 74.8 wt % builder(s)<br>25 to 89.8 wt % water<br>0.1 to 15 wt % bleaching agent(s)<br>0.01 to 15 wt % polymer containing sulfonic acid groups |

-continued

| Running number | Cleaning A, containing | Cleaning agent B, containing |
|---|---|---|
| 7 | 10 to 74.8 wt % builder(s)<br>0.1 to 10 wt % enzyme(s)<br>24.9 to 89.7 wt % water<br>0.2 to 10.0 nonionic surfactant | 10 to 74.8 wt % builder(s)<br>25 to 89.8 wt % water<br>0.1 to 15 wt % bleaching agent(s)<br>0.01 to 15 wt % polymer containing sulfonic acid groups |
| 8 | 10 to 74.7 wt % builder(s)<br>0.1 to 10 wt % enzyme(s)<br>24.9 to 89.6 wt % water<br>0.2 to 10.0 nonionic surfactant<br>0.01 to 15 wt % polymer containing sulfonic acid groups | 10 to 74.8 wt % builder(s)<br>25 to 89.8 wt % water<br>0.1 to 15 wt % bleaching agent(s)<br>0.01 to 15 wt % polymer containing sulfonic acid groups |
| 9 | 10 to 75 wt % builder(s)<br>0.1 to 10 wt % enzyme(s)<br>24.9 to 89.9 wt % water | 10 to 74.8 wt % builder(s)<br>25 to 89.8 wt % water<br>0.1 to 15 wt % bleaching agent(s)<br>0.1 to 10 wt % alkanolamine |
| 10 | 10 to 74.9 wt % builder(s)<br>0.1 to 10 wt % enzyme(s)<br>24.9 to 89.8 wt % water<br>0.01 to 15 wt % polymer containing sulfonic acid groups | 10 to 74.8 wt % builder(s)<br>25 to 89.8 wt % water<br>0.1 to 15 wt % bleaching agent(s)<br>0.1 to 10 wt % alkanolamine |
| 11 | 10 to 74.8 wt % builder(s)<br>0.1 to 10 wt % enzyme(s)<br>24.9 to 89.7 wt % water<br>0.2 to 10.0 nonionic surfactant | 10 to 74.8 wt % builder(s)<br>25 to 89.8 wt % water<br>0.1 to 15 wt % bleaching agent(s)<br>0.1 to 10 wt % alkanolamine |
| 12 | 10 to 74.7 wt % builder(s)<br>0.1 to 10 wt % enzyme(s)<br>24.9 to 89.6 wt % water<br>0.2 to 10.0 nonionic surfactant<br>0.01 to 15 wt % polymer containing sulfonic acid groups | 10 to 74.8 wt % builder(s)<br>25 to 89.8 wt % water<br>0.1 to 15 wt % bleaching agent(s)<br>0.1 to 10 wt % alkanolamine |
| 13 | 10 to 75 wt % builder(s)<br>0.1 to 10 wt % enzyme(s)<br>24.9 to 89.9 wt % water | 10 to 74.7 wt % builder(s)<br>25 to 89.7 wt % water<br>0.1 to 15 wt % bleaching agent(s)<br>0.01 to 15 wt % polymer containing sulfonic acid groups<br>0.1 to 10 wt % alkanolamine |
| 14 | 10 to 74.9 wt % builder(s)<br>0.1 to 10 wt % enzyme(s)<br>24.9 to 89.8 wt % water<br>0.01 to 15 wt % polymer containing sulfonic acid groups | 10 to 74.7 wt % builder(s)<br>25 to 89.7 wt % water<br>0.1 to 15 wt % bleaching agent(s)<br>0.01 to 15 wt % polymer containing sulfonic acid groups<br>0.1 to 10 wt % alkanolamine |
| 15 | 10 to 74.8 wt % builder(s)<br>0.1 to 10 wt % enzyme(s)<br>24.9 to 89.7 wt % water<br>0.2 to 10.0 nonionic surfactant | 10 to 74.7 wt % builder(s)<br>25 to 89.7 wt % water<br>0.1 to 15 wt % bleaching agent(s)<br>0.01 to 15 wt % polymer containing sulfonic acid groups<br>0.1 to 10 wt % alkanolamine |
| 16 | 10 to 74.7 wt % builder(s)<br>0.1 to 10 wt % enzyme(s)<br>24.9 to 89.6 wt % water<br>0.2 to 10.0 nonionic surfactant<br>0.01 to 15 wt % polymer containing sulfonic acid groups | 10 to 74.7 wt % builder(s)<br>25 to 89.7 wt % water<br>0.1 to 15 wt % bleaching agent(s)<br>0.01 to 15 wt % % polymer containing sulfonic acid groups<br>0.1 to 10 wt % alkanolamine |
| 17 | 10 to 75 wt % builder(s)<br>0.1 to 10 wt % enzyme(s)<br>24.9 to 89.9 wt % water | 10 to 74.8 wt % builder(s)<br>25 to 89.8 wt % water<br>0.1 to 15 wt % bleaching agent(s)<br>0.01 to 8 wt % cationic and/or amphoteric polymers |
| 18 | 10 to 74.9 wt % builder(s)<br>0.1 to 10 wt % enzyme(s)<br>24.9 to 89.8 wt % water<br>0.01 to 15 wt % polymer containing sulfonic acid groups | 10 to 74.8 wt % builder(s)<br>25 to 89.8 wt % water<br>0.1 to 15 wt % bleaching agent(s)<br>0.01 to 8 wt % cationic and/or amphoteric polymers |

-continued

| Running number | Cleaning A, containing | Cleaning agent B, containing |
|---|---|---|
| 19 | 10 to 74.8 wt % builder(s)<br>0.1 to 10 wt % enzyme(s)<br>24.9 to 89.7 wt % water<br>0.2 to 10.0 nonionic surfactant | 10 to 74.8 wt % builder(s)<br>25 to 89.8 wt % water<br>0.1 to 15 wt % bleaching agent(s)<br>0.01 to 8 wt % cationic and/or amphoteric polymers |
| 20 | 10 to 74.7 wt % builder(s)<br>0.1 to 10 wt % enzyme(s)<br>24.9 to 89.6 wt % water<br>0.2 to 10.0 nonionic surfactant<br>0.01 to 15 wt % polymer containing sulfonic acid groups | 10 to 74.8 wt % builder(s)<br>25 to 89.8 wt % water<br>0.1 to 15 wt % bleaching agent(s)<br>0.01 to 8 wt % cationic and/or amphoteric polymers |
| 21 | 10 to 75 wt % builder(s)<br>0.1 to 10 wt % enzyme(s)<br>24.9 to 89.9 wt % water | 10 to 74.7 wt % builder(s)<br>25 to 89.7 wt % water<br>0.1 to 15 wt % bleaching agent(s)<br>0.01 to 15 wt % polymer containing sulfonic acid groups<br>0.01 to 8 wt % cationic and/or amphoteric polymers |
| 22 | 10 to 74.9 wt % builder(s)<br>0.1 to 10 wt % enzyme(s)<br>24.9 to 89.8 wt % water<br>0.01 to 15 wt % polymer containing sulfonic acid groups | 10 to 74.7 wt % builder(s)<br>25 to 89.7 wt % water<br>0.1 to 15 wt % bleaching agent(s)<br>0.01 to 15 wt % polymer containing sulfonic acid groups<br>0.01 to 8 wt % cationic and/or amphoteric polymers |
| 23 | 10 to 74.8 wt % builder(s)<br>0.1 to 10 wt % enzyme(s)<br>24.9 to 89.7 wt % water<br>0.2 to 10.0 nonionic surfactant | 10 to 74.7 wt % builder(s)<br>25 to 89.7 wt % water<br>0.1 to 15 wt % bleaching agent(s)<br>0.01 to 15 wt % polymer containing sulfonic acid groups<br>0.01 to 8 wt % cationic and/or amphoteric polymers |
| 24 | 10 to 74.7 wt % builder(s)<br>0.1 to 10 wt % enzyme(s)<br>24.9 to 89.6 wt % water<br>0.2 to 10 nonionic surfactant<br>0.01 to 15 wt % polymer containing sulfonic acid groups | 10 to 74.7 wt % builder(s)<br>25 to 89.7 wt % water<br>0.1 to 15 wt % bleaching agent(s)<br>0.01 to 15 wt % polymer containing sulfonic acid groups<br>0.01 to 8 wt % cationic and/or amphoteric polymers |
| 25 | 10 to 75 wt % builder(s)<br>0.1 to 10 wt % enzyme(s)<br>24.9 to 89.9 wt % water | 10 to 74.7 wt % builder(s)<br>25 to 89.7 wt % water<br>0.1 to 15 wt % bleaching agent(s)<br>0.1 to 10 wt % alkanolamine<br>0.01 to 8 wt % cationic and/or amphoteric polymers |
| 26 | 10 to 74.9 wt % builder(s)<br>0.1 to 10 wt % enzyme(s)<br>24.9 to 89.9 wt % water<br>0.01 to 15 wt % polymer containing sulfonic acid groups | 10 to 74.7 wt % builder(s)<br>25 to 89.7 wt % water<br>0.1 to 15 wt % bleaching agent(s)<br>0.1 to 10 wt % alkanolamine<br>0.01 to 8 wt % cationic and/or amphoteric polymers |
| 27 | 10 to 74.8 wt % builder(s)<br>0.1 to 10 wt % enzyme(s)<br>24.9 to 89.7 wt % water<br>0.2 to 10.0 nonionic surfactant | 10 to 74.7 wt % builder(s)<br>25 to 89.7 wt % water<br>0.1 to 15 wt % bleaching agent(s)<br>0.1 to 10 wt % alkanolamine<br>0.01 to 8 wt % cationic and/or amphoteric polymers |
| 28 | 10 to 74.7 wt % builder(s)<br>0.1 to 10 wt % enzyme(s)<br>24.9 to 89.6 wt % water<br>0.2 to 10.0 nonionic surfactant<br>0.01 to 15 wt % polymer containing sulfonic acid groups | 10 to 74.7 wt % builder(s)<br>25 to 89.7 wt % water<br>0.1 to 15 wt % bleaching agent(s)<br>0.1 to 10 wt % alkanolamine<br>0.01 to 8 wt % cationic and/or amphoteric polymers |
| 29 | 10 to 75 wt % builder(s)<br>0.1 to 10 wt % enzyme(s)<br>24.9 to 89.9 wt % water | 10 to 74.6 wt % builder(s)<br>25 to 89.6 wt % water<br>0.1 to 15 wt % bleaching agent(s)<br>0.01 to 25 wt % polymer containing sulfonic acid groups<br>0.1 to 10 wt % alkanolamine<br>0.01 to 8 wt % cationic and/or amphoteric polymers |
| 30 | 10 to 74.9 wt % builder(s)<br>0.1 to 10 wt % enzyme(s)<br>24.9 to 89.8 wt % water<br>0.01 to 15 wt % polymer containing sulfonic acid groups | 10 to 74.6 wt % builder(s)<br>25 to 89.6 wt % water<br>0.1 to 15 wt % bleaching agent(s)<br>0.01 to 25 wt % polymer containing sulfonic acid groups<br>0.1 to 10 wt % alkanolamine<br>0.01 to 8 wt % cationic and/or amphoteric polymers |
| 31 | 10 to 74.8 wt % builder(s)<br>0.1 to 10 wt % enzyme(s)<br>24.9 to 89.7 wt % water<br>0.2 to 10.0 nonionic surfactant | 10 to 74.6 wt % builder(s)<br>25 to 89.6 wt % water<br>0.1 to 15 wt % bleaching agent(s)<br>0.01 to 25 wt % polymer containing sulfonic acid groups<br>0.1 to 10 wt % alkanolamine<br>0.01 to 8 wt % cationic and/or amphoteric polymers |
| 32 | 10 to 74.7 wt % builder(s)<br>0.1 to 10 wt % enzyme(s)<br>24.9 to 89.6 wt % water<br>0.2 to 10.0 nonionic surfactant<br>0.01 to 15 wt % polymer containing sulfonic acid groups | 10 to 74.6 wt % builder(s)<br>25 to 89.6 wt % water<br>0.1 to 15 wt % bleaching agent(s)<br>0.01 to 25 wt % polymer containing sulfonic acid groups<br>0.1 to 10 wt % alkanolamine<br>0.01 to 8 wt % cationic and/or amphoteric polymers |
| 33 | 10 to 75 wt % builder(s)<br>0.1 to 10 wt % enzyme(s)<br>24.9 to 89.9 wt % water | 10 to 74.9 wt % builder(s)<br>25 to 89.9 wt % water<br>0.1 to 10 wt % alkanolamine |
| 34 | 10 to 75 wt % builder(s)<br>0.1 to 10 wt % enzyme(s)<br>24.9 to 89.9 wt % water | 10 to 74.9 wt % builder(s)<br>25 to 89.9 wt % water<br>0.01 to 15 wt % polymer containing sulfonic acid groups |
| 35 | 10 to 74.9 wt % builder(s)<br>0.1 to 10 wt % enzyme(s)<br>24.9 to 89.8 wt % water<br>0.01 to 15 wt % polymer containing sulfonic acid groups | 10 to 74.9 wt % builder(s)<br>25 to 89.9 wt % water<br>0.01 to 15 wt % polymer containing sulfonic acid groups |
| 36 | 10 to 75 wt % builder(s)<br>0.1 to 10 wt % enzyme(s)<br>24.9 to 89.9 wt % water | 10 to 74.8 wt % builder(s)<br>25 to 89.8 wt % water<br>0.1 to 10 wt % alkanolamine<br>0.01 to 15 wt % polymer containing sulfonic acid groups |
| 37 | 10 to 74.9 wt % builder(s)<br>0.1 to 10 wt % enzyme(s)<br>24.9 to 89.8 wt % water<br>0.01 to 15 wt % polymer containing sulfonic acid groups | 10 to 74.8 wt % builder(s)<br>25 to 89.8 wt % water<br>0.1 to 10 wt % alkanolamine<br>0.01 to 15 wt % polymer containing sulfonic acid groups |
| 38 | 10 to 74.8 wt % builder(s)<br>0.1 to 10 wt % enzyme(s)<br>24.9 to 89.7 wt % water<br>0.2 to 10.0 nonionic surfactant | 10 to 74.9 wt % builder(s)<br>25 to 89.9 wt % water<br>0.1 to 10 wt % alkanolamine |
| 39 | 10 to 74.8 wt % builder(s)<br>0.1 to 10 wt % enzyme(s)<br>24.9 to 89.7 wt % water<br>0.2 to 10.0 nonionic surfactant | 10 to 74.9 wt % builder(s)<br>25 to 89.9 wt % water<br>0.01 to 15 wt % polymer containing sulfonic acid groups |
| 40 | 10 to 74.7 wt % builder(s)<br>0.1 to 10 wt % enzyme(s)<br>24.9 to 89.6 wt % water<br>0.2 to 10.0 nonionic surfactant<br>0.01 to 15 wt % polymer containing sulfonic acid groups | 10 to 74.9 wt % builder(s)<br>25 to 89.9 wt % water<br>0.01 to 15 wt % polymer containing sulfonic acid groups |

-continued

| Running number | Cleaning A, containing | Cleaning agent B, containing |
|---|---|---|
| 41 | 10 to 74.8 wt % builder(s)<br>0.1 to 10 wt % enzyme(s)<br>24.9 to 89.7 wt % water<br>0.2 to 10.0 nonionic surfactant | 10 to 74.8 wt % builder(s)<br>25 to 89.9 wt % water<br>0.1 to 10 wt % alkanolamine<br>0.01 to 15 wt % polymer containing sulfonic acid groups |
| 42 | 10 to 74.7 wt % builder(s)<br>0.1 to 10 wt % enzyme(s)<br>24.9 to 89.6 wt % water<br>0.2 to 10.0 nonionic surfactant<br>0.01 to 15 wt % polymer containing sulfonic acid groups | 10 to 74.8 wt % builder(s)<br>25 to 89.9 wt % water<br>0.1 to 10 wt % alkanolamine<br>0.01 to 15 wt % polymer containing sulfonic acid groups |
| 43 | 10 to 75 wt % builder(s)<br>0.1 to 10 wt % enzyme(s)<br>24.9 to 89.9 wt % water | 10 to 74.9 wt % builder(s)<br>25 to 89.9 wt % water<br>0.1 to 10 wt % alkali hydroxide |
| 44 | 10 to 75 wt % builder(s)<br>0.1 to 10 wt % enzyme(s)<br>24.9 to 89.9 wt % water | 10 to 74.8 wt % builder(s)<br>25 to 89.8 wt % water<br>0.1 to 10 wt % alkali hydroxide<br>0.01 to 15 wt % polymer containing sulfonic acid groups |
| 45 | 10 to 74.9 wt % builder(s)<br>0.1 to 10 wt % enzyme(s)<br>24.9 to 89.8 wt % water<br>0.01 to 15 wt % polymer containing sulfonic acid groups | 10 to 74.8 wt % builder(s)<br>25 to 89.9 wt % water<br>0.1 to 10 wt % alkali hydroxide<br>0.01 to 15 wt % polymer containing sulfonic acid groups |
| 46 | 10 to 74.8 wt % builder(s)<br>0.1 to 10 wt % enzyme(s)<br>24.9 to 89.7 wt % water<br>0.2 to 10.0 nonionic surfactant | 10 to 74.9 wt % builder(s)<br>25 to 89.9 wt % water<br>0.1 to 10 wt % alkali hydroxide |
| 47 | 10 to 74.8 wt % builder(s)<br>0.1 to 10 wt % enzyme(s)<br>24.9 to 89.7 wt % water<br>0.2 to 10.0 nonionic surfactant | 10 to 74.8 wt % builder(s)<br>25 to 89.8 wt % water<br>0.1 to 10 wt % alkali hydroxide<br>0.01 to 15 wt % polymer containing sulfonic acid groups |
| 48 | 10 to 74.7 wt % builder(s)<br>0.1 to 10 wt % enzyme(s)<br>24.9 to 89.6 wt % water<br>0.2 to 10.0 nonionic surfactant<br>0.01 to 15 wt % polymer containing sulfonic acid groups | 10 to 74.8 wt % builder(s)<br>25 to 89.9 wt % water<br>0.1 to 10 wt % alkali hydroxide<br>0.01 to 15 wt % polymer containing sulfonic acid groups |
| 49 | 10 to 75 wt % builder(s)<br>0.1 to 10 wt % enzyme(s)<br>24.9 to 89.9 wt % water | 10 to 74.9 wt % builder(s)<br>25 to 89.9 wt % water<br>0.1 to 10 wt % alkanolamine<br>0.01 to 8 wt % cationic and/or amphoteric polymer |
| 50 | 10 to 75 wt % builder(s)<br>0.1 to 10 wt % enzyme(s)<br>24.9 to 89.9 wt % water | 10 to 74.9 wt % builder(s)<br>25 to 89.9 wt % water<br>0.1 to 15 wt % polymer containing sulfonic acid groups<br>0.01 to 8 wt % cationic and/or amphoteric polymer |
| 51 | 10 to 74.9 wt % builder(s)<br>0.1 to 10 wt % enzyme(s)<br>24.9 to 89.8 wt % water<br>0.01 to 15 wt % polymer containing sulfonic acid groups | 10 to 74.9 wt % builder(s)<br>25 to 89.9 wt % water<br>0.1 to 15 wt % polymer containing sulfonic acid groups<br>0.01 to 8 wt % cationic and/or amphoteric polymer |
| 52 | 10 to 75 wt % builder(s)<br>0.1 to 10 wt % enzyme(s)<br>24.9 to 89.9 wt % water | 10 to 74.8 wt % builder(s)<br>25 to 89.8 wt % water<br>0.1 to 10 wt % alkanolamine<br>0.01 to 15 wt % polymer containing sulfonic acid groups |
| 53 | 10 to 74.9 wt % builder(s)<br>0.1 to 10 wt % enzyme(s)<br>24.9 to 89.8 wt % water<br>0.01 to 15 wt % polymer containing sulfonic acid groups | 10 to 74.8 wt % builder(s)<br>25 to 89.9 wt % water<br>0.1 to 10 wt % alkanolamine<br>0.01 to 15 wt % polymer containing sulfonic acid groups<br>0.01 to 8 wt % cationic and/or amphoteric polymer |
| 54 | 10 to 74.8 wt % builder(s)<br>0.1 to 10 wt % enzyme(s)<br>24.9 to 89.7 wt % water<br>0.2 to 10.0 nonionic surfactant | 10 to 74.9 wt % builder(s)<br>25 to 89.9 wt % water<br>0.1 to 10 wt % alkanolamine<br>0.01 to 8 wt % cationic and/or amphoteric polymer |

-continued

| Running number | Cleaning A, containing | Cleaning agent B, containing |
|---|---|---|
| 55 | 10 to 74.8 wt % builder(s)<br>0.1 to 10 wt % enzyme(s)<br>24.9 to 89.7 wt % water<br>0.2 to 10.0 nonionic surfactant | 10 to 74.9 wt % builder(s)<br>25 to 89.9 wt % water<br>0.01 to 15 wt % polymer containing sulfonic acid groups<br>0.01 to 8 wt % cationic and/or amphoteric polymer |
| 56 | 10 to 74.7 wt % builder(s)<br>0.1 to 10 wt % enzyme(s)<br>24.9 to 89.6 wt % water<br>0.2 to 10.0 nonionic surfactant<br>0.01 to 15 wt % polymer containing sulfonic acid groups | 10 to 74.9 wt % builder(s)<br>25 to 89.9 wt % water<br>0.01 to 15 wt % polymer containing sulfonic acid groups<br>0.01 to 8 wt % cationic and/or amphoteric polymer |
| 57 | 10 to 74.8 wt % builder(s)<br>0.1 to 10 wt % enzyme(s)<br>24.9 to 89.7 wt % water<br>0.2 to 10.0 nonionic surfactant | 10 to 74.8 wt % builder(s)<br>25 to 89.8 wt % water<br>0.1 to 10 wt % alkanolamine<br>0.01 to 15 wt % polymer containing sulfonic acid groups<br>0.01 to 8 wt % cationic and/or amphoteric polymer |
| 58 | 10 to 74.7 wt % builder(s)<br>0.1 to 10 wt % enzyme(s)<br>24.9 to 89.6 wt % water<br>0.2 to 10.0 nonionic surfactant<br>0.01 to 15 wt % polymer containing sulfonic acid groups | 10 to 74.8 wt % builder(s)<br>25 to 89.9 wt % water<br>0.1 to 10 wt % alkanolamine<br>0.01 to 15 wt % polymer containing sulfonic acid groups<br>0.01 to 8 wt % cationic and/or amphoteric polymer |
| 59 | 10 to 75 wt % builder(s)<br>0.1 to 10 wt % enzyme(s)<br>24.9 to 89.9 wt % water | 10 to 74.9 wt % builder(s)<br>25 to 89.9 wt % water<br>0.1 to 10 wt % alkali hydroxide |
| 60 | 10 to 75 wt % builder(s)<br>0.1 to 10 wt % enzyme(s)<br>24.9 to 89.9 wt % water | 10 to 74.8 wt % builder(s)<br>25 to 89.9 wt % water<br>0.1 to 10 wt % alkali hydroxide<br>0.01 to 15 wt % polymer containing sulfonic acid groups<br>0.01 to 8 wt % cationic and/or amphoteric polymer |
| 61 | 10 to 74.9 wt % builder(s)<br>0.1 to 10 wt % enzyme(s)<br>24.9 to 89.8 wt % water<br>0.01 to 15 wt % polymer containing sulfonic acid groups | 10 to 74.8 wt % builder(s)<br>25 to 89.9 wt % water<br>0.1 to 10 wt % alkali hydroxide<br>0.01 to 15 wt % polymer containing sulfonic acid groups<br>0.01 to 8 wt % cationic and/or amphoteric polymer |
| 62 | 10 to 74.8 wt % builder(s)<br>0.1 to 10 wt % enzyme(s)<br>24.9 to 89.7 wt % water<br>0.2 to 10.0 nonionic surfactant | 10 to 74.9 wt % builder(s)<br>25 to 89.8 wt % water<br>0.1 to 10 wt % alkali hydroxide<br>0.01 to 8 wt % cationic and/or amphoteric polymer |
| 63 | 10 to 74.8 wt % builder(s)<br>0.1 to 10 wt % enzyme(s)<br>24.9 to 89.7 wt % water<br>0.2 to 10.0 nonionic surfactant | 10 to 74.8 wt % builder(s)<br>25 to 89.9 wt % water<br>0.1 to 10 wt % alkali hydroxide<br>0.01 to 15 wt % polymer containing sulfonic acid groups<br>0.01 to 8 wt % cationic and/or amphoteric polymer |
| 64 | 10 to 74.7 wt % builder(s)<br>0.1 to 10 wt % enzyme(s)<br>24.9 to 89.6 wt % water<br>0.2 to 10.0 nonionic surfactant<br>0.01 to 15 wt % polymer containing sulfonic acid groups | 10 to 74.8 wt % builder(s)<br>25 to 89.9 wt % water<br>0.1 to 10 wt % alkali hydroxide<br>0.01 to 15 wt % polymer containing sulfonic acid groups<br>0.01 to 8 wt % cationic and/or amphoteric polymer |

The cleaning agents A and B labeled with running numbers 33 through 64 preferably have a bleaching agent content of less than 2 wt %, preferably less than 1 wt %, especially preferably less than 0.5 wt % and most preferably do not contain any bleaching agent.

The inventive process is suitable in particular for removing bleachable soiling such as tea stains and for cleaning off dried soiling.

The use of the inventive process for removing bleachable soiling, preferably for removing tea stains on hard surfaces and/or for cleaning off dried and/or baked soiling, in particular for cleaning off dried and/or baked soiling in machine dishwashing are therefore additional subject matters of the present patent application.

The group of dried or baked soiling includes, for example, dried starch soiling, e.g., oatmeal or burned residues of casseroles, comprising not only starch components such as noodles or potatoes but also meat residues, for example.

Other than where otherwise indicated, or where required to distinguish over the prior art, all numbers expressing quantities of ingredients herein are to be understood as modified in all instances by the term "about". As used herein, the words "may" and "may be" are to be interpreted in an open-ended, non-restrictive manner. At minimum, "may" and "may be" are to be interpreted as definitively including, but not limited to, the composition, structure, or act recited.

As used herein, and in particular as used herein to define the elements of the claims that follow, the articles "a" and "an" are synonymous and used interchangeably with "at least one" or "one or more," disclosing or encompassing both the singular and the plural, unless specifically defined herein otherwise. The conjunction "or" is used herein in both in the conjunctive and disjunctive sense, such that phrases or terms conjoined by "or" disclose or encompass each phrase or term alone as well as any combination so conjoined, unless specifically defined herein otherwise.

The description of a group or class of materials as suitable or preferred for a given purpose in connection with the invention implies that mixtures of any two or more of the members of the group or class are equally suitable or preferred. Description of constituents in chemical terms refers unless otherwise indicated, to the constituents at the time of addition to any combination specified in the description, and does not necessarily preclude chemical interactions among the constituents of a mixture once mixed. Steps in any method disclosed or claimed need not be performed in the order recited, except as otherwise specifically disclosed or claimed.

Changes in form and substitution of equivalents are contemplated as circumstances may suggest or render expedient. Although specific terms have been employed herein, such terms are intended in a descriptive sense and not for purposes of limitation.

What is claimed:

1. A method of machine cleaning dishes in a dishwashing machine, comprising a cleaning program comprising a prerinse cycle and a cleaning cycle, and comprising the steps of metering two liquid cleaning agents A and B comprising the compositions:

A:

10 to 75 wt % builder(s), 0.1 to 10 wt % enzyme(s), 24.9 to 89.9 wt % solvent(s); and

B:

10 to 74.9 wt % builder(s), 25 to 89.9 wt % solvent(s), into a wash bath during the cleaning cycle at two successive times t1 and t2, wherein the liquid cleaning agent A has a pH at 20° C. of 6 to 9 and is metered at time t1, and the liquid cleaning agent B has a pH at 20° C. of 9.5 to 14 and is metered at time t2.

2. The method of claim 1, wherein t1 differs from t2 by 2 to 30 minutes.

3. The method of claim 1, wherein the wash bath has a temperature at time t1 of 12° C. to 45° C.

4. The method of claim 1, wherein the wash bath has a temperature at time t2 of 30° C. to 65° C.

5. The method of claim 1, wherein the solvent of either liquid cleaning agent A or liquid cleaning agent B comprises water.

6. The method of claim 1, wherein the solvent of either liquid cleaning agent A or liquid cleaning agent B comprises an organic solvent.

7. The method of claim 6, wherein the organic solvent comprises an organic amine or an alkanolamine.

8. The method of claim 1, wherein the cleaning agent A has a pH at 20° C. of 6.5 to 8.5.

9. The method of claim 8, wherein the cleaning agent A has a pH at 20° C. of 7 to 8.

10. The method of claim 1, wherein the cleaning agent B has a pH at 20° C. of 9.5 to 13.

11. The method of claim 10, wherein the cleaning agent B has a pH at 20° C. of 10 to 12.

12. The method of claim 1, wherein liquid cleaning agent A and liquid cleaning agent B have pH values at 20° C. that differ by at least two units.

13. The method of claim 1, wherein liquid cleaning agent B contains 0.1 wt % to 20 wt % of a chlorine bleaching agent.

14. The method of claim 1, wherein cleaning agents A and B have a bleaching agent content of 2 wt % or less.

15. The method of claim 1, wherein cleaning agents A and B do not contain any bleaching agents.

16. The method of claim 1, wherein cleaning agent A also comprises 0.2 wt % to 10 wt % of a nonionic surfactant.

17. The method of claim 1, wherein cleaning agent A or B comprises 0.2 wt % to 12 wt % methylglycinediacetic acid or a salt of methylglycinediacetic acid.

18. The method of claim 1, wherein cleaning agent A or B has a viscosity (Brookfield viscometer LVT-II at 20 rpm and 20° C., spindle 3) of 200 mPas to 10,000 mPas.

19. The method of claim 1, wherein liquid cleaning agents A and B are stored in a water-insoluble, two-chamber or multichamber storage container prior to being metered into the wash bath.

20. The method of claim 1, wherein tea stains, dry soiling, or baked soiling are cleaned from a dish or hard surface.

* * * * *